US008265497B2

(12) United States Patent
Okada

(10) Patent No.: US 8,265,497 B2
(45) Date of Patent: Sep. 11, 2012

(54) IMAGE FORMING APPARATUS

(75) Inventor: Noriyuki Okada, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 514 days.

(21) Appl. No.: 12/211,977

(22) Filed: Sep. 17, 2008

(65) Prior Publication Data

US 2009/0080919 A1 Mar. 26, 2009

(30) Foreign Application Priority Data

Sep. 20, 2007 (JP) ..... 2007-244108

(51) Int. Cl.
*G03G 15/00* (2006.01)

(52) U.S. Cl. ..... 399/45; 399/66; 399/68

(58) Field of Classification Search ..... 399/45, 399/66–68

See application file for complete search history.

(56) References Cited

U.S. PATENT DOCUMENTS 6,285,838 B1 * 9/2001 Able et al. ..... 399/45
7,606,509 B2 * 10/2009 Yako ..... 399/68

FOREIGN PATENT DOCUMENTS

JP 2-264378 A 10/1990
JP 2002-244445 A 8/2002

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes an image bearing member for carrying a toner image; a rotatable transfer member constituting a transfer portion for transferring the toner image from the image bearing member onto a recording material; a voltage source for applying a voltage to the transfer member; an executing portion for executing an image forming mode for continuously forming an image on a plurality of recording materials having different widths measured in a direction of a rotational axis of the transfer member; an interval adjustment portion for adjusting, during execution of the image forming mode, an interval between adjacent recording materials to a first interval when the width of the recording material is larger than the width of the previous recording material, and for adjusting, during execution of the image forming mode, the interval between adjacent recording materials to a second interval when the width of the recording material is smaller than the width of the previous recording material.

6 Claims, 11 Drawing Sheets

IMAGE FORMING APPARATUS

FIELD OF THE INVENTION AND RELATED ART

The present invention relates to an image forming apparatus, such as a printer, a copying machine, a facsimile machine, a multifunction image forming apparatus, etc. More specifically, it relates to an image forming apparatus having a transferring member which rotates in contact with an image-bearing member.

An image forming apparatus having a rotatable image bearing member and a rotatable transferring member and being capable of continuously outputting a substantial number of prints, with the use of a process in which a toner image is electrostatically transferred onto a recording medium from the image bearing member while the recording medium is conveyed through the transferring portion, which is the area of contact between the image bearing member and transferring member, remaining pinched between the image bearing member and transferring member, has been put to practical use (Japanese Laid-open Patent Application H2-264378).

Generally, a transferring member is made up of a metallic core, and an elastic layer which covers virtually the entirety of the peripheral surface of the metallic core. The elastic layer is roughly 106-108 Ω·cm in electrical resistance. When a toner image is transferred onto a recording medium, electric current flows between the transferring portion and the metallic core through the elastic layer.

While a recording medium is conveyed between a transferring member and an image bearing member, the portions of the transferring member, which are outside the recording medium path in terms of the lengthwise direction of the transferring member, remain in contact with the image bearing member, allowing therefore the electric current which is to contribute to the transfer of a toner image by flowing through the recording medium, to bypass the recording medium. Thus, in order to minimize the amount of electric current which bypasses the recording medium, by minimizing the ratio in electrical resistance between the portion of the transfer portion, which is within the recording medium path, and the portions of the transfer portion, which are outside the recording medium path, the elastic layer of the transferring member is given an electrical resistance, the value of which is in the abovementioned range.

In a situation where an image forming apparatus employing a transferring member, such as the one described above, is used to for image formation, and a substantial number of recording mediums which are narrower, in terms of the direction perpendicular to the recording medium conveyance direction of the image forming apparatus, than the transfer portion of the apparatus, are consecutively conveyed in succession through the transfer portion, the following problem occurs. That is, in a situation where a substantial number of recording medium which are the same in size are consecutively conveyed through the transfer portion of the image forming apparatus to transfer a toner image onto each of the recording medium, and then, a recording medium which is one size larger than the recording mediums which have just been consecutively conveyed, is conveyed through the transfer portion to transfer an image onto the larger recording medium, the image forming apparatus outputs a print which is abnormal in that the portion of the print, which corresponds in position to the path of the recording medium of the smaller size, and the portion of the print, which does not correspond in position to the path of the recording medium of the smaller size, are different in density after fixation (Japanese Laid-open Patent Application 2002-244445). This difference in density is attributable to the lengthwise nonuniformity of the transferring member in terms of the progression of the contamination which occurs with usage, and also, in terms of the change in surface properties, which also occurs with usage. Thus, it is recommended that after a substantial number of recording mediums which are the same in size (dimension in terms of direction perpendicular to recording medium conveyance direction) are consecutively conveyed through the transfer portion to transfer a toner image onto each of the recording mediums, the peripheral surface of the image bearing member is polished and cleaned to make the peripheral surface uniform in cleanliness and properties.

However, it became evident that in a case where a substantial number of recording mediums which are the same in size (dimension in terms of direction perpendicular to recording medium conveyance direction) are continuously conveyed through the transfer portion to transfer a toner image onto each of the recording mediums, and then, a recording medium which is one size larger (greater in dimension in terms of direction perpendicular to recording medium conveyance direction) is conveyed through the transfer portion to transfer an image onto the recording medium of the larger size, the image forming apparatus outputs a print which is abnormal in that the portion of the print, which corresponds in position to the path of the recording medium of the smaller size, and the other portions of the print, are different in density after fixation, even after the peripheral surface of the image bearing member is polished and cleaned to make the peripheral surface uniform in cleanliness and properties before the formation of an image on the recording medium of the larger size It also became evident that this difference in density occurs because while a substantial number of recording mediums which are the same size, are consecutively conveyed in succession through the transfer portion, the transferring member becomes nonuniform in the amount of electrical resistance in that the portion of its elastic layer, which is within the recording medium path in terms of the direction perpendicular to the recording medium conveyance direction, and the portions of the elastic layer, which are outside the recording medium path, become different in the amount of electrical resistance.

That is, the portions of the transfer portion, which are outside the recording medium path, that is, the portion of the transfer portions, in which the image bearing member and transferring member remain directly in contact with each other, is smaller, in the ratio of the electrical current which flows through the transfer portion, than the portions of the transfer portion, which are outside the recording medium path. Therefore, the former is different in electric current density from the latter. Thus, a substantial number of recording mediums which are the same in size are consecutively conveyed in succession through the transfer portion to transfer a toner image onto each of the recording mediums, the portion of the elastic layer of the transferring member, which is within the recording medium path, and the portions of the elastic layer of the transferring member, which are outside the recording medium path, become different in the amount of electrical resistance. Further, the amount of difference corresponds to the amount of difference in electrical current density.

The above described difference in electrical resistance, the amount of which corresponds to the amount of difference in electric current density, also occurs to an elastic layer formed of a material made of a dielectric rubber or resin, and carbon particles dispersed in the dielectric rubber or resin. However, in the case of an elastic layer formed of a material made of a dielectric rubber or resin, and an ion conductive substance dispersed in the rubber or resin, as will be described later in detail, this difference is significantly greater.

If a transferring member which has become nonuniform in electrical resistance in that its portion inside the recording medium path, in terms of the direction perpendicular to the recording medium conveyance direction, has become different in the amount of electrical resistance from the portion outside the recording medium path, through an image forming operation in which a substantial number of recording mediums, which are the same in size, have been consecutively conveyed through the transfer portion, is used to transfer a toner image onto a recording medium which is one size larger than the recording mediums used in the preceding operation, the portion of the transfer portion, which is within the recording medium path becomes different in electric current density from the portion of the transfer portions which are outside the recording medium path, and therefore, the former becomes different in transfer efficiency from the latter. As a result, the image forming apparatus outputs a print which is abnormal in that the portion of the print, which corresponds in position to the path of the recording medium of the smaller size, and the other portions of the print, are different in image density, which reflects the difference in the transfer efficiency.

SUMMARY OF THE INVENTION

The primary object of the present invention is to provide an image forming apparatus capable of reducing the nonuniformity, in transfer efficiency, of the transferring member, in terms of the direction parallel to the axial line of the transferring member.

According to an aspect of the present invention, there is provided an image forming apparatus comprising an image bearing member for carrying a toner image; a rotatable transfer member constituting a transfer portion for transferring the toner image from said image bearing member onto a recording material; a voltage source for applying a voltage to said transfer member; an executing portion for executing an image forming mode for continuously forming an image on a plurality of recording materials having different widths measured in a direction of a rotational axis of said transfer member; an interval adjustment portion for adjusting, during execution of the image forming mode, an interval between adjacent recording materials to a first interval when the width of the recording material is larger than the width of the previous recording material, and for adjusting, during execution of the image forming mode, the interval between adjacent recording materials to a second interval when the width of the recording material is smaller than the width of the previous recording material, wherein the first interval is larger than the second interval; and a voltage controller for applying, to said transfer member, a voltage having a polarity which is the same as a polarity of the voltage when the tone images are transferred at said second interval.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, several preferred embodiments of the present invention will be descried in detail with reference to the appended drawings. However, these embodiments are not intended to limit the present invention in scope. That is, the present invention is also applicable, partially or in its entirety, to any image forming apparatus structured so that if switching is made from a recording medium of a smaller size to a recording medium of a larger size after a substantial number of the recording mediums of the smaller size are consecutively conveyed through the transfer portion, the recording medium conveyance intervals are widened, and electric current is flowed through the transferring member during the intervals.

Thus, not only can the present invention be applied to an image forming apparatus employing an intermediary transferring member, but also, to an image forming apparatus which transfers an image directly from its photosensitive drum onto a recording medium, an image forming apparatus which transfers a toner image onto an intermediary transferring member, and then, to a recording medium from the intermediary transfer member.

The image forming apparatus in this embodiment will be described regarding its portions essential to the formation and transfer of a toner image. However, the present invention is also applicable to various image forming apparatuses, for example, a personal printer, a personal coping machine, a personal facsimile machine, a personal multifunction image forming apparatus, and the commercial versions of the preceding apparatuses, which are made up of devices and equipment other than the abovementioned essential portions, and a housing (external frame, shell, etc.), in addition to the abovementioned essential portions.

Embodiment 1

Figure 1:
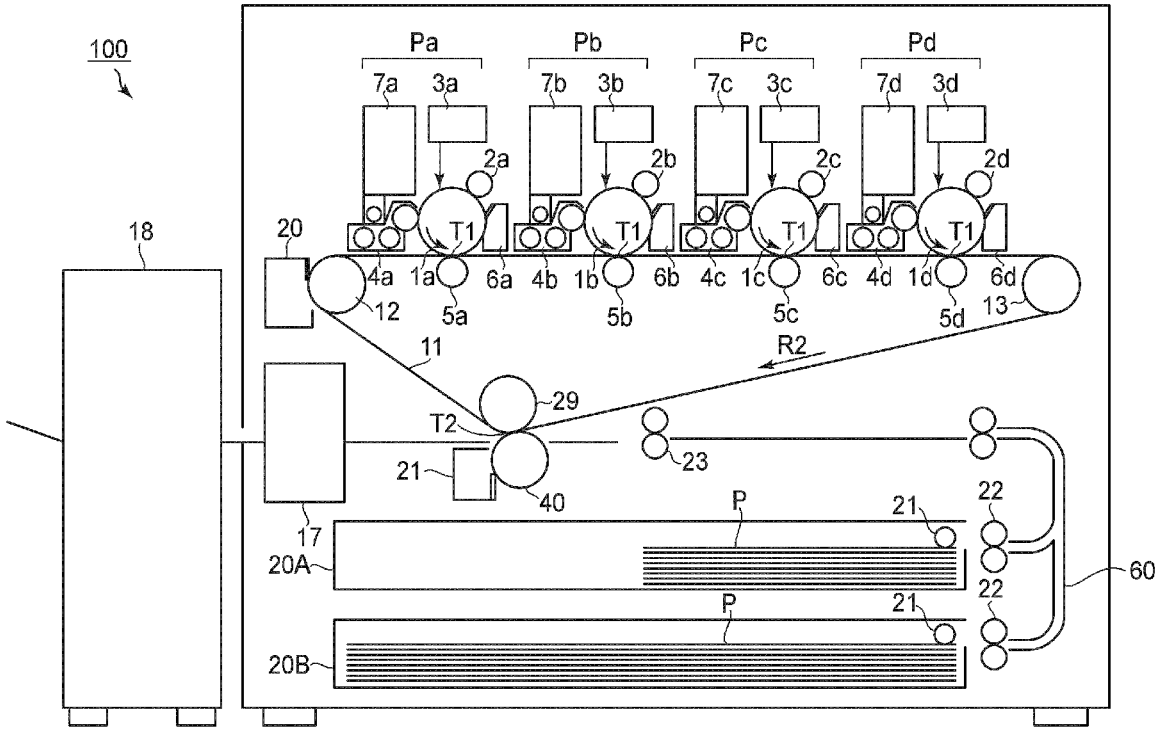
FIG. 1 is a schematic drawing of the image forming apparatus in the first preferred embodiment of the present invention, showing the structure of the apparatus.
Figure 2:
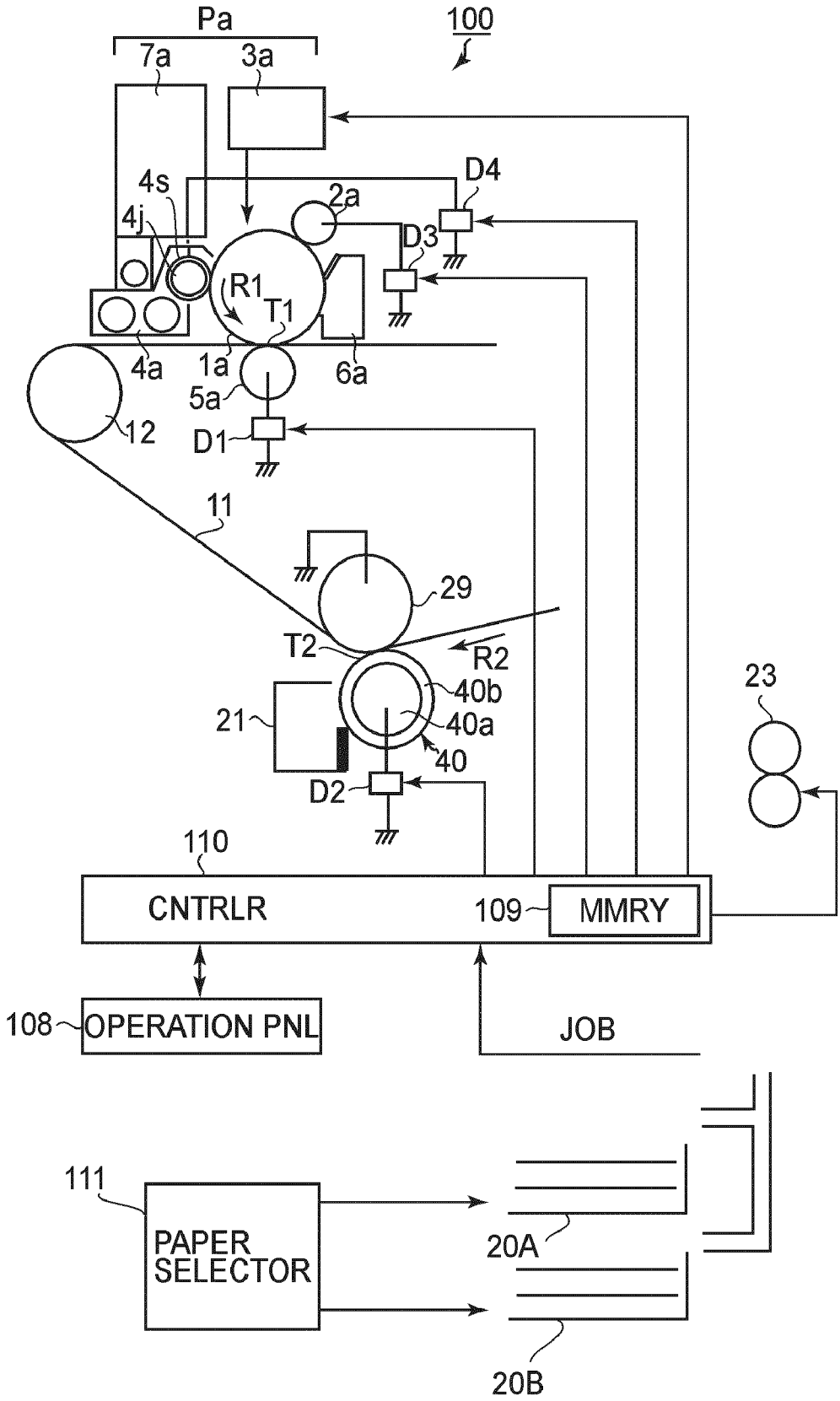
FIG. 2 is a schematic drawing of the image forming portion of the image forming apparatus, showing the structure of the portion.
Figure 3:
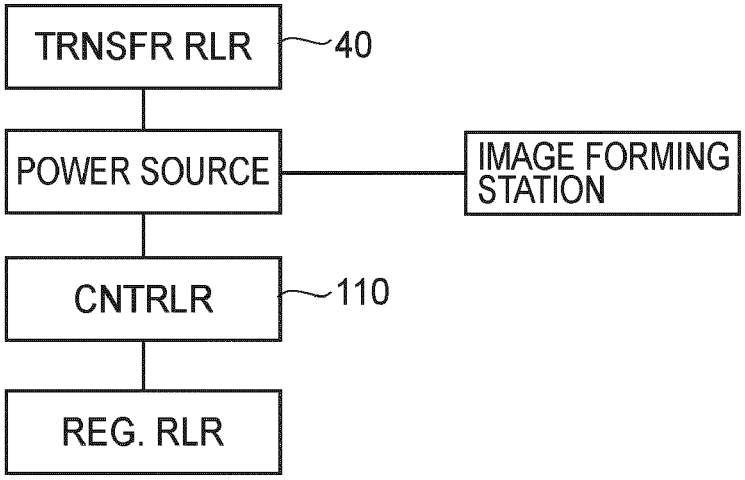
FIG. 3 is a diagram of the connection among the components of the image forming apparatus, which are involved in the transfer of a toner image.
Figure 4:
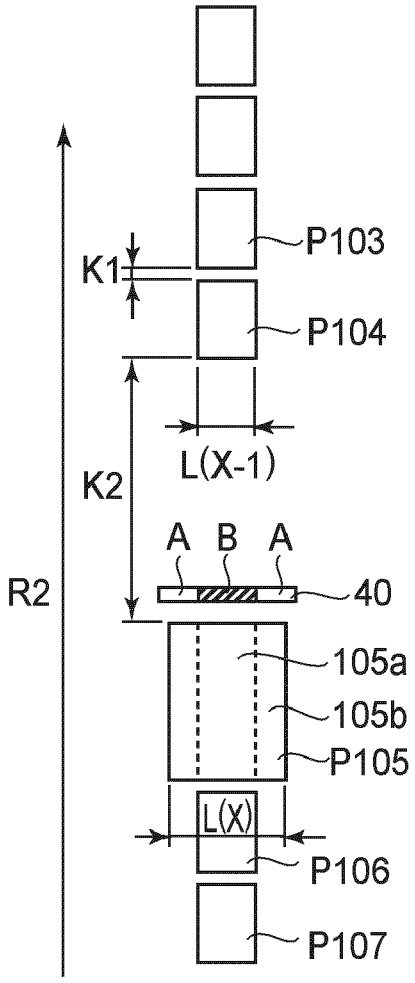
FIG. 4 is a schematic drawing for describing the recording medium intervals.

FIG. 1 is a schematic drawing of the image forming apparatus in the first preferred embodiment of the present invention, and shows the structure of the apparatus. FIG. 2 is a schematic drawing of the image forming portion of the image forming apparatus shown in FIG. 1, and shows the structure of the image forming portion. FIG. 3 is a diagram of the connection among the components of the image forming apparatus, which are involved in the transfer of a toner image. FIG. 4 is a schematic drawing for describing the recording medium intervals (recording medium conveyance interval).

Referring to FIG. 1, the image forming apparatus 100 in the first embodiment is a full-color copying machine of the so-called tandem type. That is, it has four image forming portions Pa, Pb, Pc, and Pd, and an intermediary transfer belt 11. The four image forming portions are positioned in tandem along the straight portion of the loop which the intermediary transfer belt 11 forms.

In the image forming portion Pa, a yellow toner image is formed on a photosensitive drum 1*a* as the first image bearing member, and then, is transferred (primary transfer) onto the intermediary transfer belt 11 as the second image bearing member. In the image forming portion Pb, a magenta toner image is formed on a photosensitive drum 1*b*, and then, is transferred (primary transfer) onto the intermediary transfer belt 11 in alignment with the yellow toner image on the intermediary transfer belt 11. In the image forming portions Pc and Pd, a cyan toner image and a black toner image are formed on photosensitive drums 1*c* and 1*d*, respectively, and then, are transferred in layers (primary transfer) onto the intermediary transfer belt 11 in a manner to be aligned with the yellow and magenta toner images on the intermediary transfer belt 11.

The transfer roller 40, which is a transferring member, is pressed upon the intermediary transfer belt 11, forming a secondary transferring portion T2. After the four toner images, different in color, are transferred (primary transfer) onto the intermediary transfer belt 11, they are conveyed by the movement of the intermediary transfer belt 11 to the secondary transfer portion T2, in which they are transferred together (secondary transfer) onto a recording medium P conveyed to the secondary transfer portion T2 by a pair of registration rollers 23. After the transfer (secondary transfer) of the four toner images, the recording medium P is sent to a fixing apparatus 17, in which the toner images are subjected to heat and pressure, being thereby fixed to the surface of the recording medium P. Thereafter, the recording medium P is discharged into a post-processing apparatus 18.

A sheet feeder cassette 20A contains a stack of recording mediums P of size B5, and a sheet feeder cassette 20B contains a stack of recording mediums P of size A3. The recording medium P is a UPM Fine 100 300 (300 g/m$^2$ in basis weight) (Product of UPM-Kymmene), for example.

As the size of the recording medium on which an image is to be formed is selected, a recording medium selecting apparatus 111 rotates the pickup roller 21 of the sheet feeder cassette containing the recording mediums P of the selected size to pull out the recording mediums P of the selected size.

If two or more recording mediums P are pulled out, the recording medium P which is in contact with the pickup roller 21 is separated from the rest by a separating apparatus 22, and then, is conveyed to the pair of registration rollers 23 through a recording medium conveyance passage 60. Regarding the length of the recording medium conveyance passage 60, the distance from the sheet feeder cassette 20A, that is, the top cassette, to the secondary transfer portion T2 is 600 mm, and the distance from the sheet feeder cassette 20B, that is, the bottom cassette, to the secondary transfer portion T2 is 800 mm.

The registration rollers 23 (conveying means), which are controlled by a controlling portion 110, catch the recording medium P while remaining stationary. Then, they nip the recording medium P and convey it to the secondary transfer portion T2, with the timing with which the toner images on the intermediary transfer belt 11 arrive at the secondary transfer portion T2, and also, with the provision of a preset interval between the recording medium P and the following one.

The post-processing apparatus 18 carries out post-processes, such as stapling and sorting, in coordination with the image forming apparatus 100. The post-processing apparatus 18 is capable of stapling a recording medium P of size A3 and a recording medium P of size B5 together, by folding the recording medium P of size A3. The post-processing apparatus 18 has been developed in anticipation of the possibility that an electrophotographic image forming apparatus will be widely used in the field of light-duty printing. It is capable of continuously outputting multiple prints different in recording medium size, in layers.

The image forming portions Pa, Pb, Pc, and Pd are the same in structure, although they are different in the color of the toners used by the developing apparatuses 4*a*, 4*b*, 4*c*, and 4*d* disposed next to the image forming portions Pa, Pb, Pc, and Pd, respectively. Hereafter, therefore, only the image forming portion Pa will be described. The descriptions of the image forming portions Pb, Pc, and Pd are the same as that of the image forming portion Pa, except for the suffix of their referential codes; all that is necessary is to replace the referential suffix a with b, c, or, d.

Referring to FIG. 2, the image forming portion Pa is an example of a toner image forming means. It is made up of a photosensitive drum 1*a*, a charging apparatus 2*a*, an exposing apparatus 3*a*, a developing apparatus 4*a*, a primary transfer roller 5*a*, and a cleaning apparatus 6*a*. The apparatuses 2*a*, 3*a*, 4*a*, and 6*a*, and roller 5*a* are disposed in the adjacencies of the peripheral surface of the photosensitive drum 1 in a manner to surround the peripheral surface of the photosensitive drum 1*a*.

The photosensitive drum 1*a* is made up of a piece of aluminum cylinder, and a layer of organic photo-conductor (OPC). The normal polarity to which the photo-conductor is chargeable is the negative polarity. The organic photo-conductor is coated on the peripheral surface of the aluminum cylinder in a manner to cover virtually the entirety of the peripheral surface of the aluminum cylinder. The photosensitive drum 1*a* is rotatably supported by its lengthwise end portions. It is rotated at a process speed of 300 mm/sec in the direction indicated by an arrow mark R1 by the driving force transmitted to one of its end portions from an unshown motor.

The charging apparatus 2*a* is provided with a charge roller, which is kept pressed upon the peripheral surface of the photosensitive drum 1*a* so that it will be rotated by the rotation of the photosensitive drum 1*a*. While the charge roller is rotated, a combination of DC voltage and AC voltage is applied to the charge roller from an electric power source D3. As a result, a portion of the peripheral surface of the photosensitive drum 1*a* is uniformly charged to the negative polarity as it comes into contact with the charge roller.

The exposing apparatus 3*a* writes an electrostatic latent image of an intended image on the charged portion of the peripheral surface of the photosensitive drum 1*a* by deflecting the beam of laser light it projects while modulating (turning on or off) the beam of light with the image formation data obtained by developing the yellow component of the optical image of the intended image, in a manner to scan the charged portion of the peripheral surface of the photosensitive drum 1*a*.

The developing apparatus 4*a* has a development sleeve 4*s*, and a stationary magnet which is in the hollow of the development sleeve 4*s*. The development sleeve 4*s* is rotated in such a direction that its peripheral surface moves in the opposite direction from the peripheral surface of the photosensitive drum 1*a* in the area in which the two peripheral surfaces are closest to each other. The developing apparatus 4*a* charges the toner to the negative polarity. As the development sleeve 4*s* is rotated in the abovementioned direction, the toner borne on the peripheral surface of the development sleeve 4*s* is made to crest by the magnetic pole 4j of the magnet in the development sleeve 4*s*. Thus, as the development sleeve 4*s* is rotated, the portion of the toner on the peripheral surface of the development sleeve 4*s*, which has crested, rubs the peripheral surface of the photosensitive drum 1*a*.

As the development sleeve 4*s* is rotated, an electric power source D4 applies the combination of negative DC voltage and an AC voltage to the development sleeve 4*s* so that the toner particles in the toner layer on the development sleeve 4*s* transfer onto the points of the uniformly charged portion of the peripheral surface of the photosensitive drum 1*a*, which have become positive relative to the potential level of the development sleeve 4*s*, developing in reverse the electrostatic latent image on the photosensitive drum 1*a*.

The primary transfer roller 5*a* forms a primary transfer portion T1 between the photosensitive drum 1*a* and intermediary transfer belt 11, by being kept pressed toward the photosensitive drum 1*a* by unshown springs, by its lengthwise ends, with the intermediary transfer belt 11 pinched between the primary transfer roller 5*a* and photosensitive drum 1*a*.

The primary transfer roller 5*a* is made up of a core (axle) formed of stainless steel, and an electrically resistant elastic layer formed in a manner to cover virtually the entirety of the peripheral surface of the core. The elastic layer is made of an elastic substance, such as EPDM, EPM, NBR, BR, SBR, etc., which has been made to foam in such a manner that individual or connected bubbles are generated therein.

An electric power source D1 applies a positive DC voltage to the metallic core of the primary transfer roller 5*a* so that the toner image on the photosensitive drum 1*a*, which has been formed of the negatively charged toner particles, is electrostatically transferred onto the intermediary transfer belt 11 while the toner image is moved through the primary transfer portion T1.

The cleaning apparatus 6*a* has a cleaning blade, which is placed in contact with the peripheral surface of the photosensitive drum 1*a*. As the photosensitive drum 1*a* is rotated, the cleaning blade scrapes the peripheral surface of the photosensitive drum 1*a*, removing thereby the transfer residual toner, that is, the toner remaining on the peripheral surface of the photosensitive drum 1*a* after having moved through the primary transfer portion T1, to prepare the photosensitive drum 1*a* for the following image forming step or operation.

The intermediary transfer belt 11 is another example of an image bearing member. It bears the toner images having been transferred onto it in the primary transfer portion T1, and conveys the toner images to the secondary transfer portion T2, in which the toner images are transferred (secondary transfer) onto the recording medium P. The intermediary transfer belt 11 is suspended by a tension roller 12, a driver roller 13, and a backup roller 29, and circularly moves at a preset speed (process speed) in the direction indicated by an arrow mark R2.

The intermediary transfer belt 11 is given 30 N (3 kgf) of tension by the tension roller 12, and is driven by the driver roller 13 so that it circularly moves at a speed of 300 mm/sec.

The intermediary transfer belt 11 is an endless belt. It is 370 mm in width, 900 mm in circumference, and 100 μm in thickness. It is formed of polyimide as base material, and stearyl-trimethyl ammonium dispersed as an ion conductivity resistance adjustment agent, in the polyimide, to make the volume resistivity and surface resistivity of the intermediary transfer belt 11 fall within the ranges of $10^8$-$10^{12}$ Ω·cm, and $10^{10}$-$10^{13}$ Ω·cm, respectively.

The cleaning apparatus 20 has a cleaning blade formed of polyurethane rubber. The cleaning blade is positioned so that it scrapes the intermediary transfer belt 11 to remove the transfer residual toner, that is, the toner remaining on the intermediary transfer belt 11 after having moved through the second transfer portion T2. The contact pressure of both the cleaning blade of the cleaning apparatus 6*a* and that of the cleaning apparatus 20 is 10 N (1,000 gf).

<Secondary Transfer Portion>

The secondary transfer roller 40 is an example of a transferring member. It forms the secondary transfer portion T2 between itself and intermediary transfer belt 11, by being kept pressed against the pickup roller 29, with the presence of the intermediary transfer belt 11 between the secondary transfer roller 40 and backup roller 29. While the recording medium P is moved through the secondary transfer portion T2, in such a manner that the toner images on the intermediary transfer belt 11 align with the recording medium P, the toner images transfer from the intermediary transfer belt 11 onto the recording medium P.

The backup roller 29 is a piece of stainless steel cylinder, which is 21 mm in diameter. It is grounded.

The secondary transfer roller 40 is made up of a shaft 40*a* and an elastic layer 40*b*. The shaft 40*a* is formed of stainless steel, and is 16 mm in diameter. The elastic layer 40*b* covers virtually the entirety of the peripheral surface of the shaft 40*a*, and is 4 mm in thickness. Thus, the secondary transfer roller 40 is 24 mm in overall diameter. The elastic layer 40*b* is made of a foamable synthetic rubber (NBR), and stearyl-trimethyl ammonium dispersed as an ion conductivity resistance adjustment agent, in the foamable rubber to make the volume resistivity of the elastic layer 40*b* fall within the range of $10^6$-$10^8$ Ω·cm. As other choices for the ion conductivity resistance adjustment agent, there are lauryl trimethyl ammonium, octadecyltrimethylammonium chlorate, sulfate, ethosulfate, etc. These chemicals can be used alone or in combination.

The secondary transfer roller 40 is formed of a dielectric synthetic rubber, and an ion conductivity resistance adjustment agent added thereto to make the secondary transfer roller 40 electrically conductive. Therefore, compared to a roller formed of a material formed of a synthetic rubber which contains carbon, the secondary transfer roller 40 is higher in the speed at which its resistance increases with the increase in the cumulative amount of current having flowed through the roller.

An electric power source D2, which is another example of a voltage applying means, is used to cause electric current (transfer current) to flow through the series circuit made up of the backup roller 29, intermediary transfer belt 11, recording medium P, and secondary transfer roller 40, by applying a positive constant voltage as transfer voltage to the shaft 40*a* of the secondary transfer roller 40.

However, instead of the setup used in this embodiment, negative transfer voltage may be applied to the backup roller 29 by grounding the secondary transfer roller 40. In either case, a part of the transfer current contributes to the transfer of the toner images on the intermediary transfer belt 11 by flowing through the portions of the intermediary transfer belt 11, across which the toner particles are borne.

Referring to FIG. 4, while the recording mediums P103, P104, P105, P106, and P107 are moved in the direction indicated by the arrow mark R2, five images are formed thereon, one for one.

As a substantial number of toner images are consecutively transferred in succession onto the same number of recording mediums, one for one, which are the same in size, the portions A of the secondary transfer roller 40, which are outside the path of the recording medium P103, P104, etc., and the portion B of the secondary transfer roller 40, which is within the recording medium path, eventually become different in the amount of electrical resistance, because the portion of the transfer portion (T2 in FIG. 2), which corresponds in position to the portion B is higher in electrical resistance than the portions of the transfer portion, which correspond in position to the portions A, by the amount equal to the amount of electrical resistance of the recording medium P, and therefore, falls behind the portions A in terms of the cumulative amount of electric current.

If a recording medium P105 is used as recording medium after the portions A of the secondary transfer roller 40 and the portion B of the secondary transfer roller 40 became different in electrical resistance (which hereafter may be referred to simply as resistance) because a substantial number of recording mediums which were smaller in size than the recording medium P105 were consecutively conveyed in succession through the transfer portion T2, the portion B becomes different in current density from the portions A. The difference in the current density between the portion B and portions A manifests as difference in transfer efficiency between the portion B and portions A. Thus, a print which is abnormal in that the portion of the image thereon, which corresponds to the area 105*a* of the recording medium P105, is different in density from the portion of the image, which corresponds to the area 105*b* of the recording medium P105. This difference in image density is attributable to the above described difference in toner image transfer efficiency between the portion B which corresponds to the area 105*a*, and the portions A, which correspond to the areas 105*b*.

Thus, in a case where the recording medium P105, which is larger by one size than the recording medium P104, is used after no less than 100 prints, which are the same in size (recording mediums P104), have been consecutively outputted in succession, the control portion 110 carries out a resistance difference reduction control sequence for reducing the difference in the amount of resistance between the portions A and portion B of the secondary transfer roller 40.

Referring to FIG. 4, which is a schematic drawing, the control portion 110 is the CPU of the image forming apparatus 100, and is capable of functioning as a portion for carrying out an image forming operation in which a large number of toner images are consecutively transferred in succession onto the same number of recording mediums, one for one, which are different in dimension in terms of the direction parallel to the axial line of the transferring member. More specifically, the control portion 110 is capable of controlling the recording medium interval by controlling the operation of the registration rollers. The control portion 110 is also capable of functioning as a recording medium interval adjusting portion which adjusts the recording medium interval by controlling the operation of the registration rollers described above. That is, as switching is made from a recording medium of a smaller size, that is, a recording medium which is smaller in dimension in terms of the direction parallel to the axial line of the transferring member, to a recording medium of a larger size, that is, a recording medium which is greater in dimension in terms of the direction parallel to the axial line of the transferring member, after a substantial number of prints are consecutively outputted in succession with the use of the recording mediums of the smaller size, the control portion 110 increases the recording medium conveyance interval from the first interval, that is, the interval with which the recording medium of the smaller size are conveyed, to the second interval, that is, the interval with which the recording mediums of the larger size are conveyed. Further, the control portion 110 is capable of functioning as a voltage controlling portion for applying to the transferring portion a voltage which is the same in polarity as the voltage applied while the recording mediums of the smaller size are conveyed with the second intervals to transfer toner images.

Also referring to FIG. 4, K2 stands for the interval between the last of the substantial number of the recording mediums of the smaller size, which have been consecutively conveyed in succession, and the recording medium of the larger size, to which switching is made. K1 stands for the intervals with which the recording mediums of the smaller size are conveyed. Ta stands for the value of K2, and Ta stands for the value of K1.

In a case where a toner image is transferred onto a recording medium (P) after recording mediums, which are smaller in dimension than the recording medium (P) in terms of the lengthwise direction of the secondary transfer roller 40, have been consecutively used in succession by a number greater than a preset value, the control portion (110) controls the toner image forming means (3*a*) so that the intervals (K2) with which a toner image is formed on the image bearing member (11) widen. Then, it rotates the image bearing member (11) and transferring member (40) while keeping them in contact with each other, and applying to the transferring member a voltage which is the same in polarity as, but higher than, the voltage having been applied while the recording mediums of the smaller size were consecutively conveyed in succession for image transfer.

<Resistance Difference Reduction Control Sequence>

Figure 5:
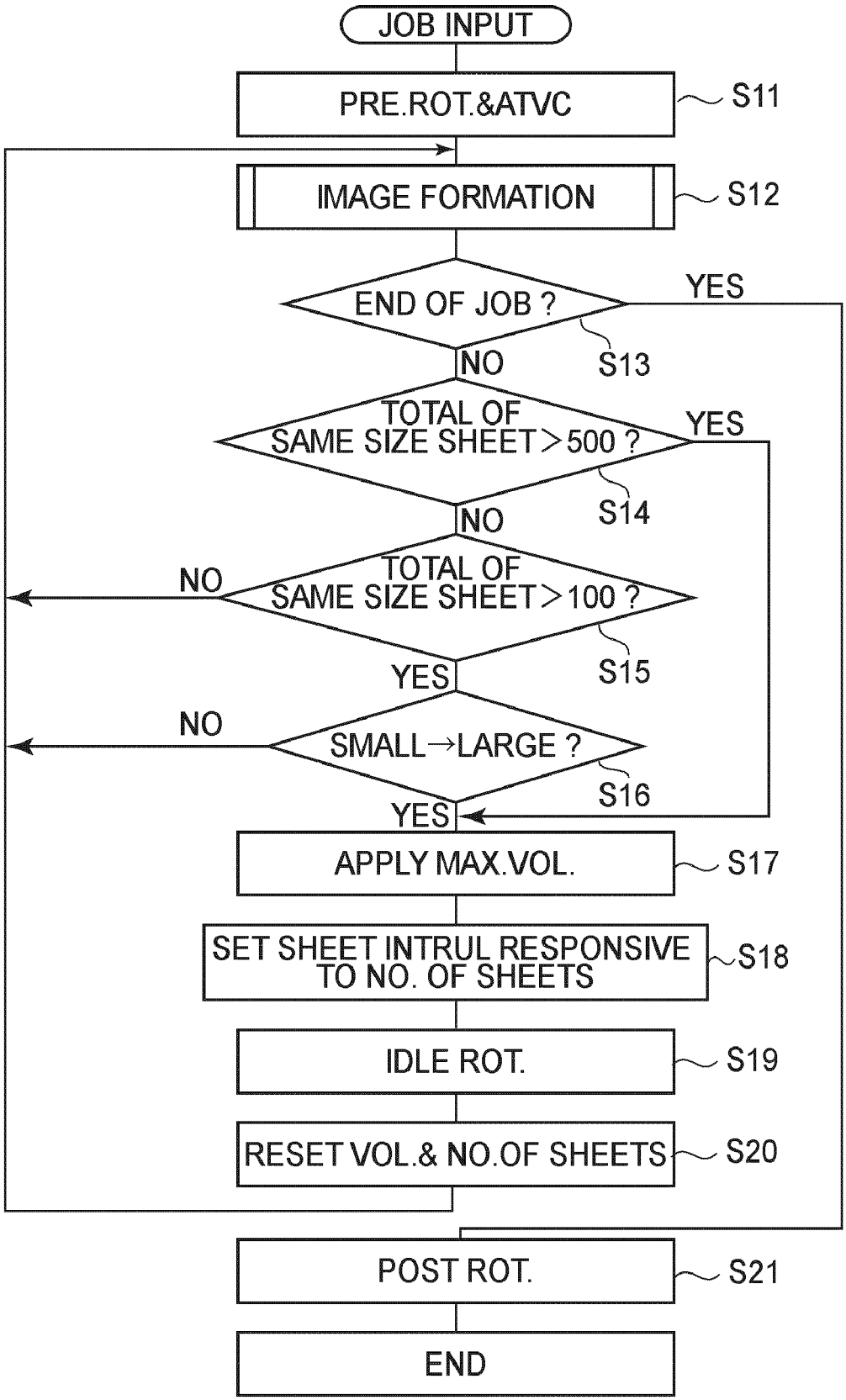
FIG. 5 is a flowchart of the image forming operation.

FIG. 5 is a flowchart of the control sequence for reducing the difference in the amount of the electrical resistance.

Referring to FIG. 2, in the resistance difference reduction control sequence, the control portion 110 increases the intervals with which toner images are borne on the intermediary transfer belt 11, using the exposing apparatus 3*a*, which is an example of a toner image forming means, to control the intervals with which toner images are formed on the photosensitive drum 1*a*. That is, if switching is made from the recording mediums having been used, to a recording medium (P) which is greater in width (dimension parallel to axial line of transferring member), the control portion 110 widens the recording medium conveyance interval from K1 to K2 as shown in FIG. 4.

Referring again to FIG. 2, the control portion 110 causes the secondary transfer roller 40 and intermediary transfer belt 111 to idle for a length of time which corresponds to the recording medium interval K2, while applying to the secondary transfer roller 40 the maximum amount of voltage, which is the same in polarity as the voltage applied during the normal transferring operation, from the electric power source D2, and also, while keeping the secondary transfer roller 40 and intermediary transfer belt 11 in contact with each other. In other words, the control portion 110 causes the secondary transfer roller 40 and intermediary transfer belt 11 to idle while flowing electric current through them.

Figure 14:
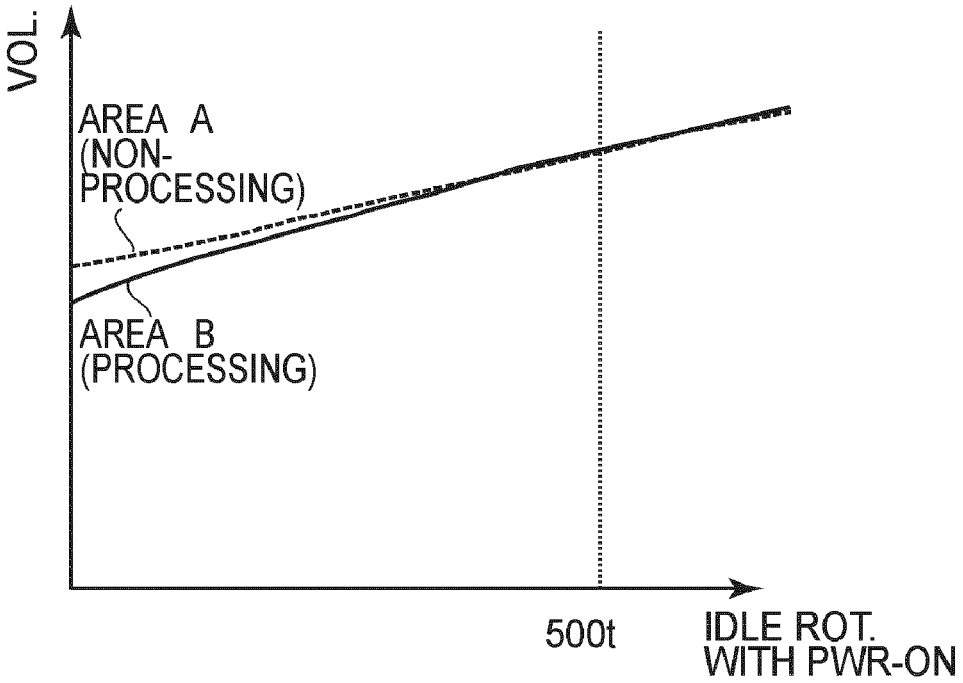
FIG. 14 is a graph for describing the length of time the secondary transfer roller is idled in the electrical resistance difference reduction control sequence, while flowing electric current through the roller.

During this operation, current flows more through the portion B than through the portions A, because the resistance of the portion B has become lower than that of the portions A through the preceding continuous image transfer. Therefore, the portion B quickly catches up with the portions A in terms of the cumulative amount of current density, quickly reducing thereby the difference between the portion B and portions A in the amount of resistance (FIG. 14).

Next, referring to FIG. 5 as well as FIG. 2, as the control portion 110 receives a signal indicating the reception of a job, it begins to rotate (pre-rotation) the photosensitive drum 1*a* and intermediary transfer belt 11 to carry out the ATVC sequence (S11).

The ATVC sequence, which is an example of a constant voltage setting sequence, is for setting a value for the constant voltage which is to be outputted from the electric power source D2 to the secondary transfer roller 40 during the next toner image transfer.

The elastic layer of the secondary transfer roller 40 contains an ion conductivity resistance adjustment agent. Thus, as current is flowed through the secondary transfer roller 40, the transfer roller 40 gradually increases in the amount of resistance. Thus, the control portion 110 ensures that the amount of current which flows through the secondary transfer portion T2 remains at a target level, which in this embodiment is 40 μA, by increasing gradually (in small steps) the constant voltage by carrying out the ATVC sequence.

More specifically, the control portion 110 detects the amount by which current flows into the secondary transfer roller 40 while changing in steps the voltage which it causes the electric power source D2 to output, and rotating the intermediary transfer belt 11, backup roller 29, and secondary transfer roller 40. The control portion 110 sets a value for the base voltage Vb by adjusting the voltage so that the amount of the current converges to the target amount, which is 40 μA. The value to which the base voltage Vb is set first in this embodiment is 1,500 V, and this value is kept by the control portion 110 until the base voltage Vb needs to be reset in the next ATVC sequence.

The control portion 110 causes the electric power source D2 to output to the secondary transfer roller 40 a constant voltage Vp, the value of which equals the sum of the base voltage Vb and a voltage Vp, that is, the voltage applied to compensate for the resistance of recording medium, during the next toner image transfer (constant voltage V2=Vb+Vp). The value of the voltage Vp is set according to the resistance value of the recording medium P, and is stored in advance in a data storage apparatus 109. In the case of the recording medium P, which is of the above described type, the value of the voltage Vp is 750 V. Therefore, the constant voltage is 2,250 V (=1,500+750).

However, the constant voltage of 2,250 V is appropriate only when the image forming apparatus 100 is in the early stage of its service life, and the ambient temperature and humidity are 25° C. and 60% RH, respectively. The resistance of the elastic layer 40*b* of the secondary transfer roller 40 increases with the increase in the cumulative amount by which current flowed through the elastic layer 40*b*. Thus, there is a correlation between the resistance of the secondary transfer roller 40 (elastic layer 40*b*) and the cumulative length of usage of the secondary transfer roller 40. Further, if there is a change in the ambient temperature and/or humidity, the voltage Vp is set to a value different from the value prior to the change in the ambient temperature and/or humidity.

At the end of the ATVC sequence, the control portion 110 starts the image forming operation (S12). Then, as the job is completed (YES in S13), the control portion 110 carries out the post-rotation sequence (S21), and then, stops the intermediary transfer belt 11 and photosensitive drum 1*a*.

In the case of an image forming operation for consecutively outputting in succession a substantial number of prints, using recording mediums (P103, P104 . . . ) which are the same in size (dimension in terms of lengthwise direction of secondary transfer portion T2), the control portion 110 keeps the recording medium interval K1 (FIG. 4) set to 30 mm. Then, the number of the recording mediums onto which a toner image was transferred reaches 500, that is, an example of a preset number, the control portion 110 unconditionally carries out the resistance difference reduction control sequence (S17-S20), for the following reasons:

That is, if the secondary transfer roller 40 becomes excessively large in the nonuniformity in electrical resistance in terms of the direction parallel to its axial line, it requires a large amount of time to erase the nonuniformity in electrical resistance, substantially increasing thereby the amount of waiting time. A number, for example, 500, by which recording mediums are conveyed before the resistance difference reduction control sequence is unconditionally carried out, is set to be greater than a number, for example, 100, by which recording mediums are conveyed before the resistance difference control sequence is carried out because switching was made from the consecutively conveyed recording mediums to a recording medium greater in size than the consecutively conveyed recording mediums.

As long as the number by which recording mediums, which are the same in size, are consecutively conveyed in succession for image transfer, is no more than 100 (No in S15), the control portion 110 keeps the recording medium interval (K1 in FIG. 4) at 30 mm, because as long as the number is no more than 100, the above described difference in the amount of resistance does not become large enough to make the portion of the secondary transfer roller, which is within the recording medium path, significantly different in transfer efficiency from the portion of the secondary roller, which is outside the recording medium path.

In a case of an image forming operation for consecutively outputting in succession a substantial number of prints, if the number of recording mediums which have been consecutively conveyed in succession for image formation exceeds 100, which is an example of the first number (YES in S15), the control portion 110 carries out the resistance difference reduction control sequence (S17-S20) as soon as switching is made from the recording mediums having been consecutively conveyed in succession to a recording medium greater in width than the consecutively conveyed recording mediums (YES in S16).

In the resistance difference reduction control sequence (S17-S20), the control portion 110 causes the intermediary transfer belt hand the secondary transfer roller 40 to idle for a length of time which is longer than the length of time necessary to rotate the secondary transfer roller 40 one full turn, with the presence of no toner image on the belt 11, while applying to the secondary transfer roller 40 a voltage which is the same in polarity as the voltage applied during the normal transfer operation.

A print which is nonuniform in density in that the portion corresponding to the portion B of the secondary transfer roller is different in image density from the portions corresponding to the portions A of the secondary transfer roller is outputted immediately after switching is made from the recording mediums having been consecutively conveyed in succession for image transfer, to a recording medium which is larger the consecutively conveyed recording mediums. Therefore, in an image forming operation in which the recording mediums which are the same in size are consecutively conveyed in succession, or after the switching was made to a recording medium of the smaller size, the control portion 110 does not carry out the resistance difference reduction control sequence (S17-S20)

Referring to FIG. 4, the control portion 110 carries out the resistance difference reduction control sequence (S17-S20) when the relationship between the width L(X) (dimension in terms of lengthwise direction of secondary transfer portion) of the recording medium P used to output the Xth print, and the width L(X−1) of the recording medium P used to output (X−1)th print, satisfies the following inequity:

$$L(X)>L(X-1).$$

The control portion 110 switches the value for the constant voltage through the ATVC sequence to the maximum value by controlling the electric power source D2 (S17). The maximum value equals the value of the highest normal voltage, that is, the voltage applied when cardboard or the like is used as the recording medium. The effects of the difference in terms of the cumulative amount of current between a portion of the secondary transfer roller 40 and another portion(s) of the secondary transfer roller 40, which occurred through an image forming operation in which a substantial number of prints which are the same in size were consecutively outputted in succession, with the transfer voltage fixed to a preset value, can be reduced in a very short length of time by flowing a large amount of current. That is, the difference in resistance can be very efficiently erased by applying a large amount of current. In this embodiment, 4,000 V which is twice the highest value (2,000 V) for the base voltage Vb, which can be obtained through the ATVC sequence, is applied.

The control portion 110 sets the recording medium interval (K2 in FIG. 4) according to the number by which prints, which are the same in size, have been consecutively outputted in succession (S18), because the occurrence of the nonuniformity, in resistance of the secondary transfer roller 40, is attributable to the nonuniformity, in cumulative amount of current, of the secondary transfer roller 40, the extent of which corresponds to the abovementioned number of prints.

The recording medium interval K2 needs to be set to a value which is no less than the circumference of the secondary transfer roller 40, because the secondary transfer roller 40 has to be reduced in nonuniformity in resistance, also in terms of its circumferential direction.

The recording medium interval K2 is desired to be set to a value which is no less than the length of the intermediary transfer belt 11, because not only can setting the recording medium interval K2 to a value which is no less than the length of the intermediary transfer belt 11 reduce the nonuniformity of the secondary transfer roller 40, but also, the nonuniformity, in resistance, of the intermediary transfer belt 11 in terms of the width direction of the intermediary transfer belt 11.

In the first preferred embodiment, the recording medium conveyance interval T was set using the following equation, in which t stands for the length of time it takes for the secondary transfer roller 40 to rotate one full turn, and Y stands for the cumulative number by which recording mediums P of the same size have been consecutively conveyed in succession:

$$T=0.5\times Y\times t.$$

The control portion 110 idles the photosensitive drum 1*a* and intermediary transfer belt 11, with the recording medium interval (K2 in FIG. 4) set to 7,500 mm, for example, and the recording medium conveyance interval to 25 seconds (S19), to reduce the nonuniformity in resistance of the secondary transfer roller 40 in terms of the direction parallel to the axial line of the secondary transfer roller 40.

Then, the control portion 110 switches the value for the constant voltage from the highest one to the base voltage, and resets the counter for the cumulative number by which recording mediums which are the same in size are consecutively conveyed in succession (S20).

Thereafter, the control portion 110 keeps the recording medium interval (K1 in FIG. 4) at 30 mm until the recording medium is switched to a wider one (YES in S16) from the recording mediums which are consecutively conveyed in succession after the cumulative number by which the recording mediums are fed exceeds 100 (YES in S15).

Incidentally, in the ATVC sequence, that is, the sequence for setting the value for the constant voltage to be applied to the secondary transfer roller 40 during an image forming operation, the secondary transfer roller 40 is rotated while a voltage which is the same in polarity as the voltage applied to the secondary transfer roller 40 during an image forming operation is applied to the secondary transfer roller 40. Therefore, even while the ATVC sequence is carried out, the difference in resistance between the portions A and B shown in FIG. 4 reduces as it does through the resistance difference reduction control sequence (S17-S20). However, the length of time the secondary transfer roller 40 is rotated while current is flowed through it, is no more than 10 t, which is very short, that is, not long enough to significantly reduce the abovementioned difference in resistance, which is substantial.

In other words, in the case of a job which is no more than 100 in the number of prints to be produced, the nonuniformity in resistance can be sufficiently erased by the ATVC sequence, which is carried out during the pre-rotation, and therefore, the control portion 110 does not carry out the resistance difference reduction control sequence (S17-S20 in FIG. 5).

Further, the image forming apparatus 100 is capable of operating in the noncontinuous image formation mode, that is, the mode in which only a single print is outputted, and in the continuous image formation mode, that is, the mode in which two or more prints are consecutive outputted in succession. The control portion 110 carries out the ATVC sequence once even when the image forming apparatus 100 is in the noncontinuous mode. Therefore, when the image forming apparatus 100 is in the noncontinuous mode, the control portion 110 does not carry out the resistance difference reduction control sequence (S17-S20 in FIG. 5).

In the case of the image forming apparatus 100 in this embodiment, recording mediums P of size B4, which are relatively narrow, are stored in the sheet feeder cassette 20A, or the top cassette, and recording mediums P of size A3, which are wider than the recording medium P of size B, are stored in the sheet feeder cassette 20B, or the bottom cassette. However, the resistance difference reduction control sequence is carried out even when the recording medium P of size B5 is stored in the sheet feeder cassette 20B, and the recording medium P of size A3 is stored in the sheet feeder cassette 20A. In other words, the resistance difference reduction control sequence is carried out regardless of the length of the sheet conveyance passage 60, that is, whether a recording medium is delivered through the recording medium conveyance passage 60 corresponding to the top sheet feeder cassette, or through the recording medium conveyance passage 60 corresponding to the bottom sheet feeder cassette.

EXPERIMENT 1

Figure 6:
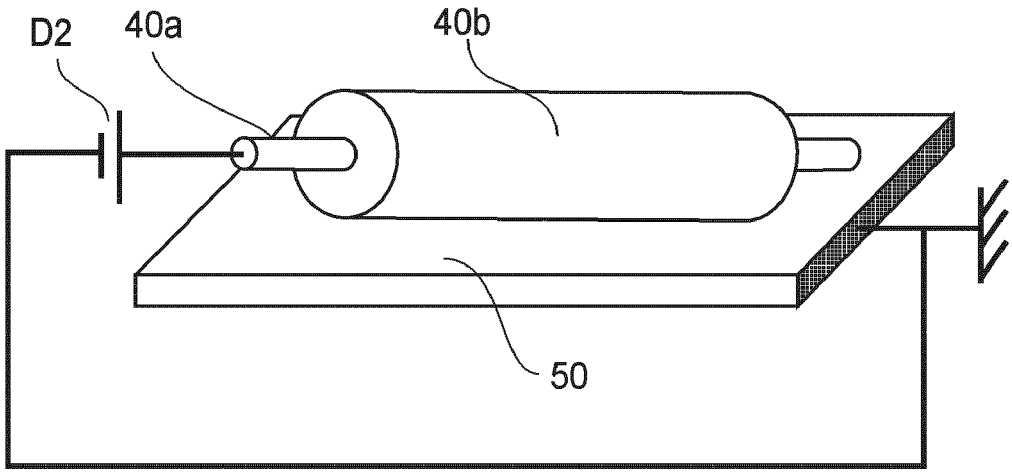
FIG. 6 is a schematic drawing for describing the method for measuring the amount of the electrical resistance of the secondary transfer roller.
Figure 7:
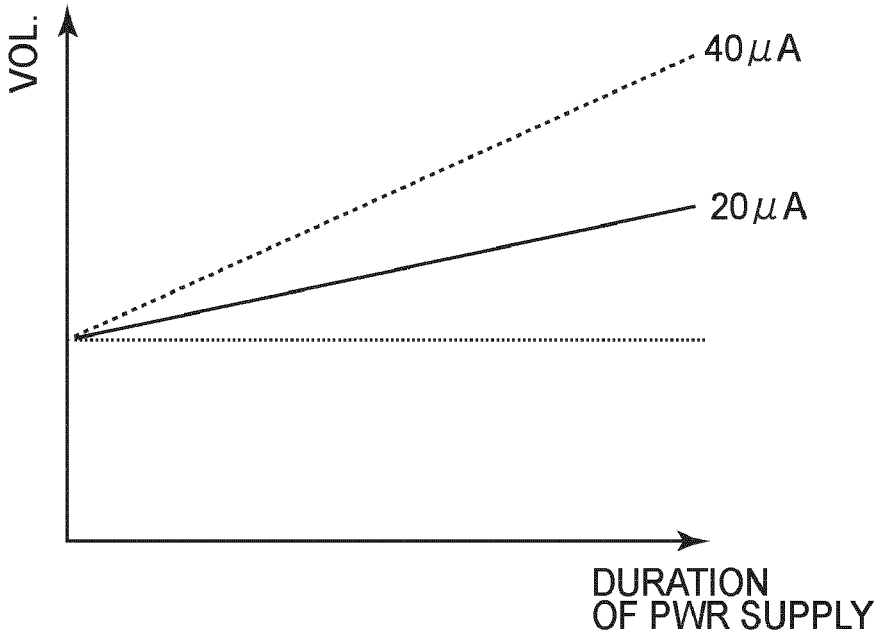
FIG. 7 is a graph showing the changes in the amount of the electrical resistance of the secondary transfer roller.
Figure 8:
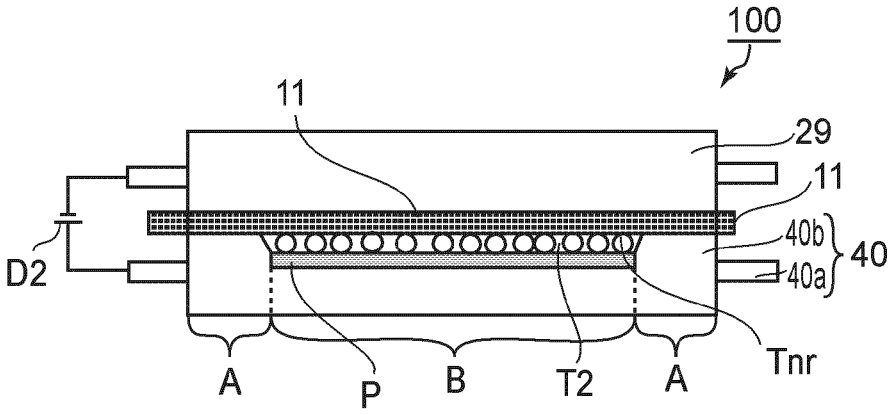
FIG. 8 is a schematic drawing of the secondary transfer portion in which a toner image is being transferred.

FIG. 6 is a schematic drawing for describing the method for measuring the amount of the resistance of the secondary transfer roller. FIG. 7 is a graph showing the changes in the electrical resistance of the secondary transfer roller. FIG. 8 is a schematic drawing of the secondary transfer portion in which a toner image is being transferred.

It has been said that if current is continuously flowed in the same direction through the elastic layer (40*b* in FIG. 2), which contains an ion conductivity adjustment agent, the elastic layer changes in the state of dispersion of the ion conductive substance in the elastic layer, which results in increase in the resistance of the elastic layer.

Referring to FIG. 6, the following experiment was carried out: The secondary transfer roller 40 was solidly attached to a metallic plate 50, which was grounded. Then, the values for the constant voltage, which were necessary to flow target amounts (20 μA and 40 μA) of current, were determined while applying voltage to the shaft 40*a* of the secondary transfer roller 40 from the electric power source D2.

Referring to FIG. 7, the amount of the resistance of the elastic layer 40*b* increased with the increase in the cumulative length of time the voltage was applied (increase in cumulative amount of current flowed), increasing thereby the constant voltage, in magnitude, necessary to keep at a preset level the amount of current flowing through the secondary transfer roller 40. When the target amount of current was 40 μA, the speed at which the cumulative amount of current increased was twice that when the target amount of current was 20 μA. However, when the target amount of current was 40 μA, the speed at which the resistance of the elastic layer 40*b* increased, and the speed at which the constant voltage had to be increased, were roughly twice those when the target amount of current was 20 μA. Therefore, the relationship between the amount of current and the amount of resistance became as follows:

Amount of increase in resistance=(constant)×(amount of current flowing through secondary transfer roller 40)×(length of time current flowed).

Next, referring to FIG. 8, the secondary transfer roller 40 is kept pressed against the backup roller 29 with the presence of intermediary transfer belt 11 between the secondary transfer roller 40 and backup roller 29, forming the secondary transfer portion T2 between the intermediary transfer belt 11 and secondary transfer roller 40, through which the recording medium P is conveyed, while remaining pinched by the intermediary transfer belt 11 and secondary transfer roller 40, so that the toner images on the intermediary transfer belt 11 align with the recording medium P in terms of the direction perpendicular to the surface of the recording medium P.

The portions of the elastic layer 40*b* of the secondary transfer roller 40, which came in contact with the toner Tnr were indented by the toner Tnr and recording medium P, whereas the portions of the elastic layer 40*b*, which were outside the path of the recording medium P were in contact with the intermediary transfer belt 11. Therefore, the portion B of the secondary transfer roller 40, which was within the path of the recording medium P, that is, in contact with the recording medium P, became lower in resistance than the portions A of the secondary transfer roller 40, becoming therefore greater than the portions A, in the density of the current which flowed when the constant voltage was applied to the secondary transfer roller 40.

Provided that the recording medium P, intermediary transfer belt 11, and secondary transfer roller 40 remain stable in the amount of resistance, and the toner Tnr is not present between the recording medium P and intermediary transfer belt 11, the relationship between the density I(A) of the current which flows through the portion A, and the density I(B) of the current which flows through the portion B is as follows:

$$I(B)=2/3\times I(A).$$

The current density I(A) becomes 1.5 times the current density I(B), and therefore, the resistance of the portion A increases at 1.5 times the speed at which the resistance of the portion B increases, gradually increasing the difference between the amount of resistance of the portion A and that of the portion B. In reality, however, as the resistance of the portion A increases, the amount by which current flows through the portion A decreases, which in turn reduces the speed at which the resistance of the portion A increases. However, it still holds that as a large number of recording mediums, in particular, recording mediums of the same size, are consecutively conveyed in succession through the secondary transfer portion T2, the secondary transfer roller 40 becomes nonuniform in resistance.

Here, if the intermediary transfer belt 11 and secondary transfer roller 40 are increased in resistance by a substantial amount (two digits or so), the difference in the amount of current between the portions A and B becomes insignificant, because the presence or absence of the recording medium P becomes insignificant in terms of the resistance of the series circuit made up of the intermediary transfer belt 11, recording medium P, and secondary transfer roller 40.

However, if the intermediary transfer belt 11 and secondary transfer roller 40 are increased in electrical resistance by a drastic amount (by two digits or so), it becomes impossible to keep the amount of the current flowing through the series circuit at the target level, unless the constant voltage, which is outputted by the electric power source D2, is increased by a drastic amount. If the constant voltage is increased, not only does the image forming apparatus 100 increase in power consumption, but also, electrical discharge occurs in the adjacencies of the secondary transfer portion T2, having ill effects upon the secondary transfer, which are undesirable.

EXPERIMENT 2

Figure 9:
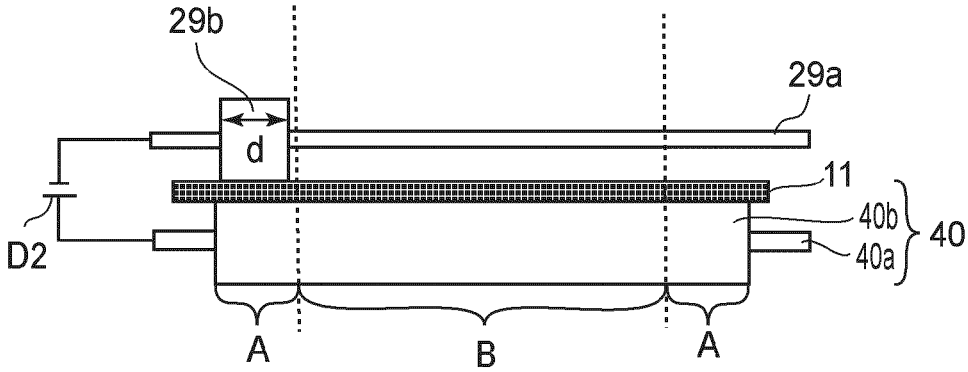
FIG. 9 is a schematic drawing of a test model of an apparatus for measuring the electrical resistance of the portion of the transferring portion, which is outside the recording medium path.
Figure 10:
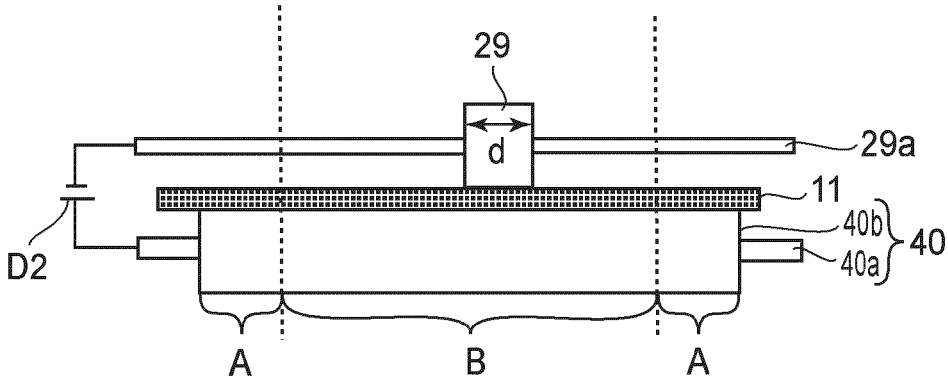
FIG. 10 is a schematic drawing of a test model of an apparatus for measuring the electrical resistance of the portion of the transferring portion, which is within the recording medium path.
Figure 11:
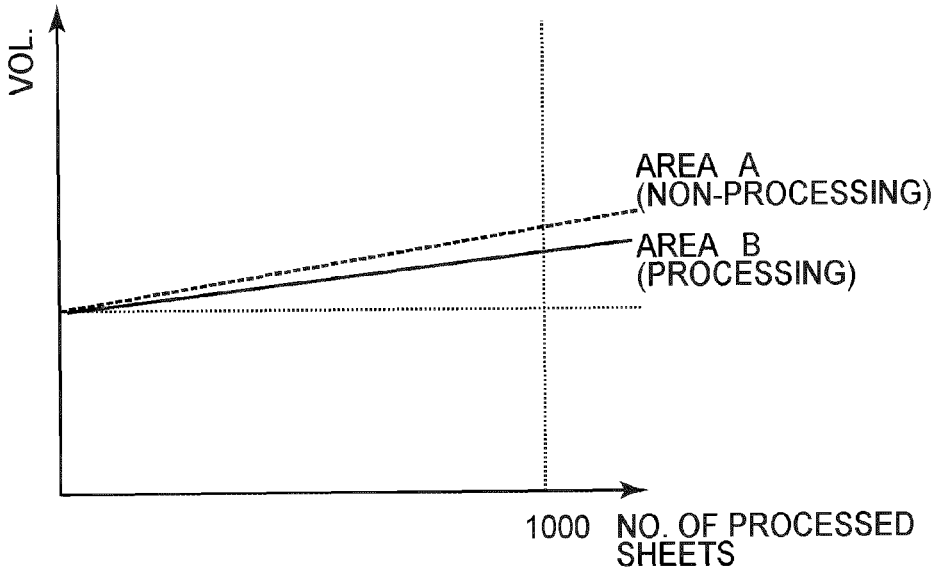
FIG. 11 is a graph showing the change in the amount of electrical resistance of the portion of the secondary transfer roller, which is within the recording medium path, and the change in the amount of electrical resistance of the portions of the secondary transfer roller, which are outside the recording medium path.

FIG. 9 is a schematic drawing of a test model of an apparatus for measuring the amount of the resistance of the portion of the secondary transfer roller 40, which is outside the recording medium path in terms of the direction parallel to the axial line of the secondary transfer roller 40. FIG. 10 is a test model of an apparatus for measuring the amount of the resistance of the portion of the secondary transfer roller 40, which is inside the recording medium path in terms of the direction parallel to the axial line of the secondary transfer roller 40. FIG. 11 is a graph showing the changes in the resistance of the portion of the secondary transfer roller 40, which is outside the recording medium path, and the resistance of the portion of the secondary transfer roller 40, which is inside the recording medium path.

The difference in the amount of resistance between the portions A and B (difference in amount of voltage necessary to flow a preset amount of current), which were obtained with the use of the test models shown in FIGS. 9 and 10 are shown in FIG. 11. Incidentally, the structural items shown in FIGS. 9 and 10, which are the same as the counterparts in FIG. 8, are given the same referential codes as those given in FIG. 8, one for one, and their description will not be given to avoid repeating the same descriptions.

Referring to FIG. 9, in order to measure the amount of the resistance of the portion A, the backup roller 29 of the image forming apparatus 100, which is shown in FIG. 8, was replaced with a backup roller 29*b*, which contacts only one of the two portions A of the secondary transfer roller 40, and the dimension of which in terms of the direction parallel to the axial line of the secondary transfer roller 40 is d. Then, the amount of the output voltage of the electric power source D2 was measured while supplying 5 μA (target amount) of current, which is proportional to the amount d.

Referring to FIG. 10, in order to measure the amount of the resistance of the portion B, the backup roller 29 of the image forming apparatus 100, which is shown in FIG. 8, was replaced with a backup roller 29*b*, which contacts only the portions B of the secondary transfer roller 40, and the dimension of which in terms of the direction parallel to the axial line of the secondary transfer roller 40 is also d. Then, the amount of the output voltage of the electric power source D2 was measured while supplying 5 μA (target amount) of current, which is proportional to the amount d.

Referring to FIG. 11, the inventors of the present invention made the image forming apparatus 100 carry out an image forming operation in which 1,000 prints, the toner image on which was the same in size as the recording medium, and which were 50%, that is, the maximum ratio, in toner deposition amount, were consecutively outputted in succession while feeding the ordinary recording papers of size A4 in such a manner that the long edges of the recording papers were parallel to the recording medium conveyance direction. During the operation, the amounts of the voltage output of the electric power source D2, which corresponded to the portions A and B, were measured.

The experiment revealed that the portion A, which was outside the recording medium path, was greater in the speed at which the amount of the voltage outputted by the electric power source D2 increased, than the portion B, and by the time the 1,000 prints were outputted, the difference in the amount of resistance between the portions A and B had grown large enough to affect the toner image transfer.

EXPERIMENT 3

Figure 12:
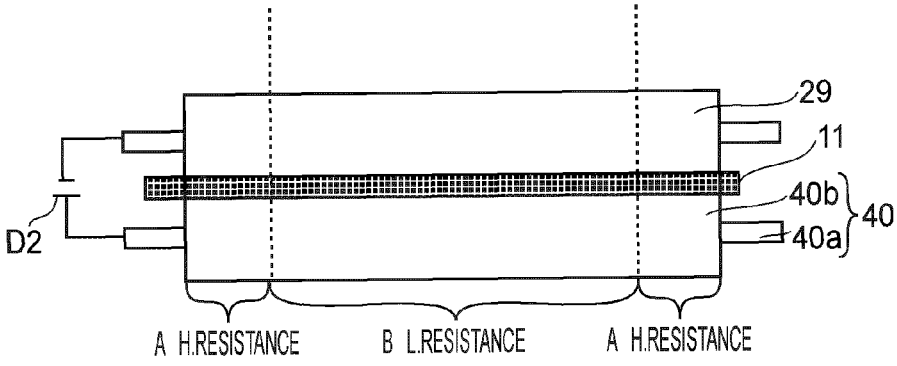
FIG. 12 is a schematic drawing of the secondary transfer roller having become nonuniform in electrical resistance.
Figure 13:
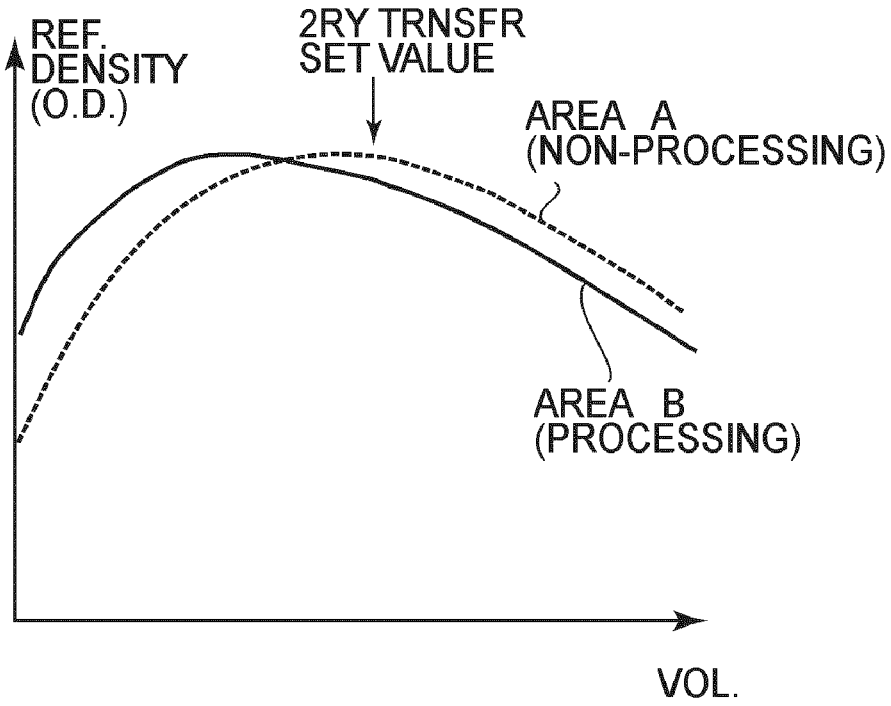
FIG. 13 is a graph showing the relationship between the magnitude of the constant voltage and the image density level.

FIG. 12 is a schematic drawing of the secondary transfer roller, which has become nonuniform in resistance. FIG. 13 is a graph showing the relationship between the constant voltage and image density.

An experiment was carried out to compare the portions A and B in transfer efficiency, with the use of the secondary transfer roller, shown in FIG. 2, the portion A of which became different in resistance from the portion B.

Referring to FIG. 12, 1,000 prints, which were the same in size, were consecutively outputted in succession with the use of a brand-new secondary transfer roller 40, that is, a secondary transfer roller which was uniform in resistance, so that the portion A of the roller 40 became higher in the resistance than the portion B. Then, as in the second experiment, a substantial number of prints, which were the same (A4) in recording medium size, and were 50%, that is, the maximum ratio, in toner deposition ratio, were consecutively outputted in succession while feeding the ordinary recording papers of size A4 in such a manner that the long edges of the recording papers were parallel to the recording medium conveyance direction, with the paper interval set to 30 mm.

Thereafter, an image which was the same in size as a recording medium of size A3, which was one size larger than a recording medium of size A4, was formed on a recording medium of size A3 under the same condition as the one described above. During the operation, the constant voltage applied to the secondary transfer roller 40 was changed in magnitude in steps, and the density level of the fixed image was measured at each level of the constant voltage, with the use of a densimeter (X-Rite).

Referring to FIG. 13, the value of the constant voltage, at which the portion B peaked (portion B is highest in transfer efficiency) in terms of image density, was slightly smaller than the value of the constant voltage, at which the portion A peaked (portion A was highest in transfer efficiency). This result is attributable to the phenomenon that current flowed at a higher density level through the portion A than the portion B, and therefore, the portion A increased faster in resistance than the portion B.

The value to which the constant voltage was set to flow a target amount (40 μA) of current, and which is referred to as the normal secondary transfer value, is represent by Vn in the drawing. When the value of the constant voltage was equal to the value of the normal secondary transfer voltage Vn, the portion A was higher in transfer efficiency than the portion B. Therefore, a print having a "density step" between the portion of the print, which corresponded to the portion A of the secondary transfer roller 40, and the portion of the print, which corresponded to the portion B of the secondary transfer roller 40, was formed. In other words, a print of size A3, the lateral edge portions of which were higher in density than the center portion, was formed.

If the normal secondary transfer voltage Vn was shifted toward the lower side, the difference in density (transfer efficiency) between the portions A and B reduced. However, when the normal second transfer voltage Vn was shifted toward the lower side, the problem that such a full-color image that was 200% in the total amount of toner deposition was sometimes unsatisfactorily transferred (secondary transfer). In other words, shifting the normal secondary transfer voltage Vn toward the lower side is not a feasible solution.

To describe in more detail, the normal secondary transfer voltage Vn was set a value in the range in which the image forming apparatus 100 outputs such a print that the portion corresponding to the portion B was slightly lower in density than the portion corresponding to the portion corresponding to the portion A, for the following reason. That is, since the image forming apparatus (100 in FIG. 1) is a full-color image forming apparatus, it sometimes transfers a toner image which is no less than 200% in toner deposition ratio. Thus, in order to ensure that even when a toner image which is no less than 200% in total toner deposition ratio is transferred, the areas of the recording medium P are provided with a sufficient amount of transfer electric charge, the constant voltage was set to a value slightly higher than necessary.

EXPERIMENT 4

FIG. 14 is a graph for describing the length of time the intermediary transfer belt 11 and secondary transfer roller 40 are idled during the resistance difference reduction control sequence.

Referring to FIG. 13, after 1,000 prints, which were the same in the size of the recording medium, were consecutively outputted in succession, the portions A of the secondary transfer roller 40 were greater in resistance than the portion B of the secondary transfer roller 40.

If the intermediary transfer belt 11 and secondary transfer roller 40 are idled while flowing current through the secondary transfer portion T2 by applying to the secondary transfer roller 40 a voltage which is the same in polarity as the voltage applied during an image forming operation, the current density I(B), that is, the density of the current which flows through the portion B, which is lower in resistance, is higher than the current density I(A), that is, the density of the current which flows through the portion A, which is higher in resistance. If the idling of the intermediary transfer belt 11 and secondary transfer roller 40 is continued in this condition, the resistance of the portion B, which is lower than that of the portion A, increases at a higher rate than the resistance of the portion A, gradually reducing the difference in resistance between the portions B and A. Obviously, the reduction in the difference in resistance between the portions B and A enables the image forming apparatus 100 to output a print which is smaller in difference in density between the portion corresponding to the portion A and the portion corresponding to the portion B.

Referring to FIG. 4, in the first embodiment, the resistance difference reduction control sequence (S17-S20 in FIG. 5) is carried out when an image is formed on the recording medium P105 after a substantial number of prints which are identical in recording medium size, and are narrower than the recording medium P105, were consecutively outputted in succession.

If the intermediary transfer belt 11 and secondary transfer roller 40 are idled while applying to the secondary transfer roller 40 a voltage which is opposite in polarity from the voltage applied during an image forming operation, current flows in the opposite direction from the direction in which current flows during an image forming operation. Therefore, the resistance of the elastic layer 40*b* reduces toward the value of the resistance which the elastic layer 40*b* had when the secondary transfer roller 40 was brand-new, because, as current flows in the opposite direction, the elastic layer 40*b* is restored in the state of the dispersion of the ion conductive substance therein.

However, the current density I(B), that is, the current density of the portion B which is relatively low in resistance, becomes higher than the current density I(A), that is, the current density of the portion A which is relatively high in resistance. Therefore, the portion B becomes higher in the resistance reduction speed than the portion A. Further, the portion B is initially lower in resistance than the portion A. Therefore, the difference in resistance between the portions A and B expands. As the difference in resistance between the portions A and B expands, a print which is more nonuniform in density in that the portion corresponding to the portion A and the portion corresponding the portion B are more different in density, is outputted.

Therefore, the voltage to be applied to the secondary transfer roller 40 during the resistance difference reduction control sequence (S17-S20 in FIG. 5) must be the same in polarity as the voltage to be applied during an image forming operation.

Further, the higher the voltage to be applied to the secondary transfer roller 40, the shorter the length of time it takes to erase the difference in resistance between the portions B and A. Therefore, the voltage to be applied to the secondary transfer roller 40 during the resistance difference reduction control sequence is desired to be as high as possible within the range in which unnecessary temperature increase does not occur in the secondary transfer portion T2 and/or unnecessary electrical discharge does not occur in the adjacencies of the secondary transfer portion T2.

FIG. 14 shows the disappearance of the difference in resistance between the portions A and B, which occurs as the intermediary transfer belt 11 and secondary transfer roller 40 are idled while applying to the secondary transfer roller 40 a voltage, which is twice, in magnitude, the normal secondary transfer voltage (Vn in FIG. 13).

As in the second experiment, a substantial number of prints which were A4 in size and 50% (maximum rate) in toner deposition ratio, and the toner image on which was the same in size as the recording medium (A4), were consecutively outputted in succession while feeding the recording mediums in such a manner that the longer edges of the recording medium were parallel to the recording medium conveyance direction, and the recording medium interval was set to 30 mm, using a brand-new secondary transfer roller 40.

After the portions A and B of the secondary transfer roller 40 were made significantly different in the amount of resistance through the above described process, the secondary transfer roller 40 was mounted in the test apparatus shown in FIGS. 9 and 10. Then, the output voltage of the electric power source D2 was measured while controlling the electric power source D2 so that a preset amount of current flowed through the transfer portion. The target value for the current of the electric power source D2 was set to the value of the current of the electric power source D2 which was detected while applying a voltage which was twice the normal secondary transfer voltage (Vn in FIG. 13). The axis representing the length of the elapsed time shows how many times the secondary transfer roller 40 was rotated, and t stands for the length of time it took for the secondary transfer roller 40 to rotate one full turn.

Referring to FIG. 14, the difference in resistance between the portions A and B of the secondary transfer roller 40, which was created by consecutively outputting 1,000 prints in succession, disappeared as the secondary transfer roller 40 was idled 500 times while supplying current through the secondary transfer roller 40. After idling the secondary transfer roller 40, 500 times, while flowing current through the secondary transfer roller 40, a print of size A3, which was 50% in toner deposition ratio, a print of size A3, which was 100% in toner deposition ratio, and a print of size A3, which was 200% in toner deposition ratio, were outputted while feeding the recording mediums in such a manner that the long edges of the recording medium became parallel to the recording medium conveyance direction. None of the prints suffered from the "density step" and/or other image defects.

Therefore, in the first embodiment, when the number by which prints were consecutively outputted in succession was Y, the length T of time the secondary transfer roller 40 was to be idled while flowing current through the secondary transfer roller 40 was set to a value obtained using the following equation:

$$T=1/2Y\times t.$$

Embodiment 2

Figure 15:
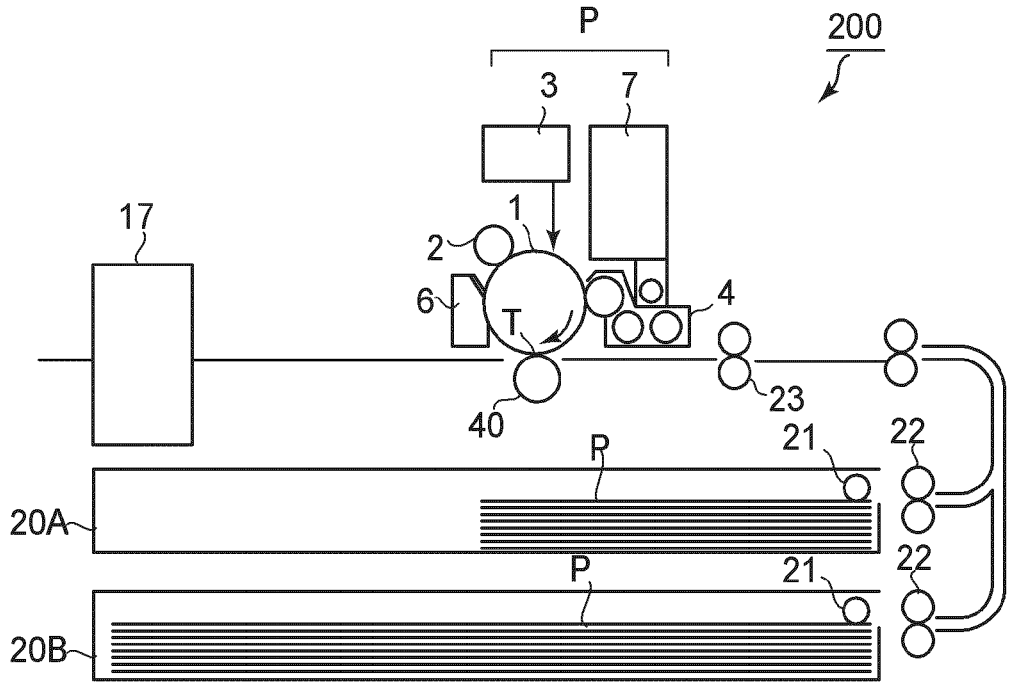
FIG. 15 is a schematic drawing of the image forming apparatus in the second preferred embodiment of the present invention, showing the structure of the apparatus.

FIG. 15 is a schematic drawing of the image forming apparatus in the second preferred embodiment of the present invention, and shows the structure of the apparatus.

Figure 16:
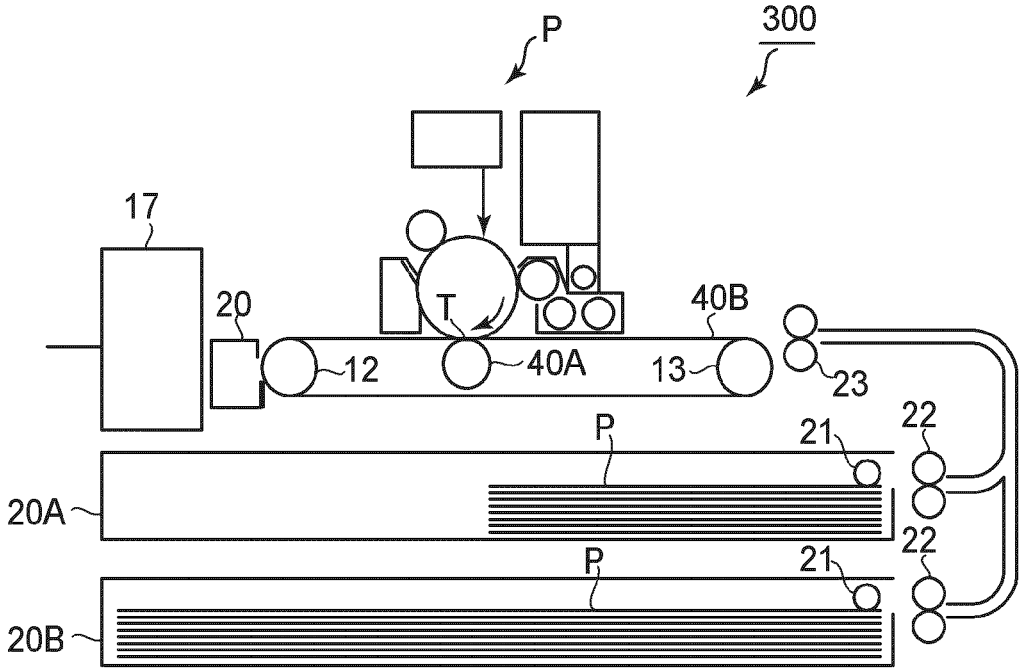
FIG. 16 is a schematic drawing of the image forming apparatus in the third preferred embodiment of the present invention, showing the structure of the apparatus.

The image forming apparatus 200 in the second embodiment is the same in structure as that in the first embodiment, except that the image forming apparatus 200 has only one photosensitive drum, that is, a photosensitive drum 1, and only one image forming portion, that is, an image forming portion P, and transfers a toner image onto recording medium directly from the photosensitive drum 1. Thus, the components of the apparatus 200, which are shown in FIGS. 15 and 16, and are the same in structure as the counterparts of the image forming apparatus 100 in the first embodiment, are given the same referential codes, one for one, as the codes given to the counterparts, and will not be described to avoid repeating the same descriptions. Further, the description of the image forming portion P regarding its structural components is the same as that of the image forming portion Pa shown in FIGS. 1 and 2, except for the suffix a used to differentiate the four image forming portions of the image forming apparatus 100.

Referring to FIG. 15, in the image forming portion P of the image forming apparatus 200, a black toner image is formed on the photosensitive drum 1. Then, the black toner image is transferred onto a recording medium P directly from the photosensitive drum 1 in the transfer portion T. After the transfer of the toner image onto the recording medium P in the transfer portion T, the recording medium P is subjected to heat and pressure in the fixing apparatus 17 so that the toner image becomes fixed to the surface of the recording medium P. Then, the recording medium P is discharged from the image forming apparatus 200.

The image forming portion P is made up of the photosensitive drum 1, a charging apparatus 2, an exposing apparatus 3, a developing apparatus 4, a primary transfer roller 5, and a cleaning apparatus 6. The apparatuses 2, 3, 4, and 6, and roller 5 are disposed in the adjacencies of the peripheral surface of the photosensitive drum 1 in a manner to surround the peripheral surface of the photosensitive drum 1.

The charging apparatus 2 charges a part of the peripheral surface of the photosensitive drum 1 to the negative polarity. The exposing apparatus 3 writes an electrostatic latent image on the charged portion of the peripheral surface of the photosensitive drum 1 by deflecting the beam of laser light it projects while modulating (turning on or off) the beam of light with the image formation data obtained by developing the optical image of the intended image, in a manner to scan the charged portion of the peripheral surface of the photosensitive drum 1.

The developing apparatus 4 develops in reverse the electrostatic image on the peripheral surface of the photosensitive drum 1 by supplying the photosensitive drum 1 with negatively charged toner. The toner image formed on the peripheral surface of the photosensitive drum 1 is conveyed to the transfer portion T by the rotation of the photosensitive drum 1 as the photosensitive drum 1 is rotated in the direction indicated by an arrow mark. Then, the toner image is transferred onto the recording medium P which is conveyed to the transfer portion T by a pair of registration rollers 23.

To the transfer roller 40, a positive constant voltage is applied from the electric power source D2 shown in FIG. 2. As the positive constant voltage is applied to the transfer roller 40, the transfer roller 40 causes the negatively charged toner image on the peripheral surface of the photosensitive drum 1 to transfer onto the recording medium P.

Referring to FIG. 2, the transfer roller 40 is made up of a core (axle) 40*a* formed of stainless steel, and an electrically resistant elastic layer 40*b* formed in a manner to cover virtually the entirety of the peripheral surface of the core. The elastic layer 40*b* is made of a foamable synthetic rubber in which an ion conductive resistance adjustment agent has been dispersed to adjust the substance in resistance.

Referring to FIG. 4, consecutively outputting in succession no less than 100 prints, which are identical in recording medium size (recording medium 104), makes the portions A of the transfer roller 40 and the portion B of the transfer roller 40 different in resistance by an amount which cannot be overcome by the ATVC sequence which is carried out once per job.

Therefore, in a case where no less than 100 prints which are identical in recording medium size, are consecutively outputted in succession, and then, another image is formed on a recording medium 109, which is greater (wider) than the recording mediums which have been used in the preceding continuous image forming operation, the resistance difference reduction control sequence (S17-S20 in FIG. 5) is carried out before the operation for forming an image on the wider recording medium 109 is started.

In the resistance reduction control sequence, the recording medium interval is increased from K1 to K2, and in order to make the portion B, which is relatively low in resistance, significantly greater in the amount of current than the portion A. Thus, the portion B becomes closer in the cumulative amount of current per unit area to the portion A, reducing thereby the difference in the amount of resistance between the two portions.

Embodiment 3

FIG. 16 is a schematic drawing of the image forming apparatus in the third preferred embodiment of the present invention, and shows the structure of the apparatus.

The image forming apparatus 300 in the third embodiment is the same in structure as that in the second embodiment, except that the image forming apparatus 300 is structured so that a toner image is transferred onto a recording medium P which is adhered to a recording medium conveyance belt 40B and conveyed by the recording medium conveyance belt 40B while remaining adhered thereto. Thus, the portions of the image forming portion P of the image forming apparatus 300, which are the same as the counterparts of the image forming apparatus 200 in the second embodiment, will not be described to avoid repeating the same descriptions.

Referring to FIG. 16, in the case of the image forming apparatus 300, the recording medium P is delivered to the recording medium conveyance belt 40*b*, and is conveyed by the recording medium conveyance belt 40B to the transfer portion T while remaining electrostatically adhered to the recording medium conveyance belt 40B.

The recording medium conveyance belt 40B is given a preset amount of tension by the tension roller 12, and is driven by the driver roller 13. The recording medium conveyance belt 40B is similarly structured to the intermediary transfer belt 11 in the first embodiment. That is, it is formed of polyimide as base material, and an ion conductivity resistance adjustment agent dispersed in the polyimide to make the volume resistivity of the recording medium conveyance belt 40B fall within the range of $10^8$-$10^{12}$ Ω·cm.

The transfer roller 40A is similarly structured to the transfer roller 40 in the second embodiment. That is, it is made up of a core (axle) 40*a* formed of stainless steel, and an elastic layer 40*b* formed in a manner to cover virtually the entirety of the peripheral surface of the core. The elastic layer 40*b* is made of a foamable synthetic rubber, and an ion conductivity resistance adjustment agent dispersed in the synthetic rubber to adjust the elastic layer in resistance.

Also in the case of the image forming apparatus 300, consecutively outputting in succession no less than 100 prints, which are the same in recording medium size, makes the portions A and B of the transfer roller 40A different in resistance by an amount which the ATVC sequence, which is carried out once per job, cannot sufficiently reduce.

Thus, in a case where no less than 100 prints which are identical in recording medium size, are consecutively outputted in succession, and then, another image is formed on a recording medium, which is greater (wider) than the recording mediums which have been used in the preceding continuous image forming operation, the resistance difference reduction control sequence (S17-S20 in FIG. 5) is carried out before the operation for forming an image on the wider recording medium is started.

In the resistance difference reduction control sequence, the recording medium interval is increased, and transfer roller 40A is idled while a voltage, which is maximum in value and is the same in polarity as the voltage applied to the transfer roller 40A during normal transfer. Thus, the portion B, which is lower in resistance than the portion A, becomes significantly greater in the amount of current than the portion A. Thus, the portion B becomes closer in the cumulative amount of current per unit area to the portion A, reducing thereby the difference in the amount of resistance between the two portions.

Embodiment 4

Figure 17:
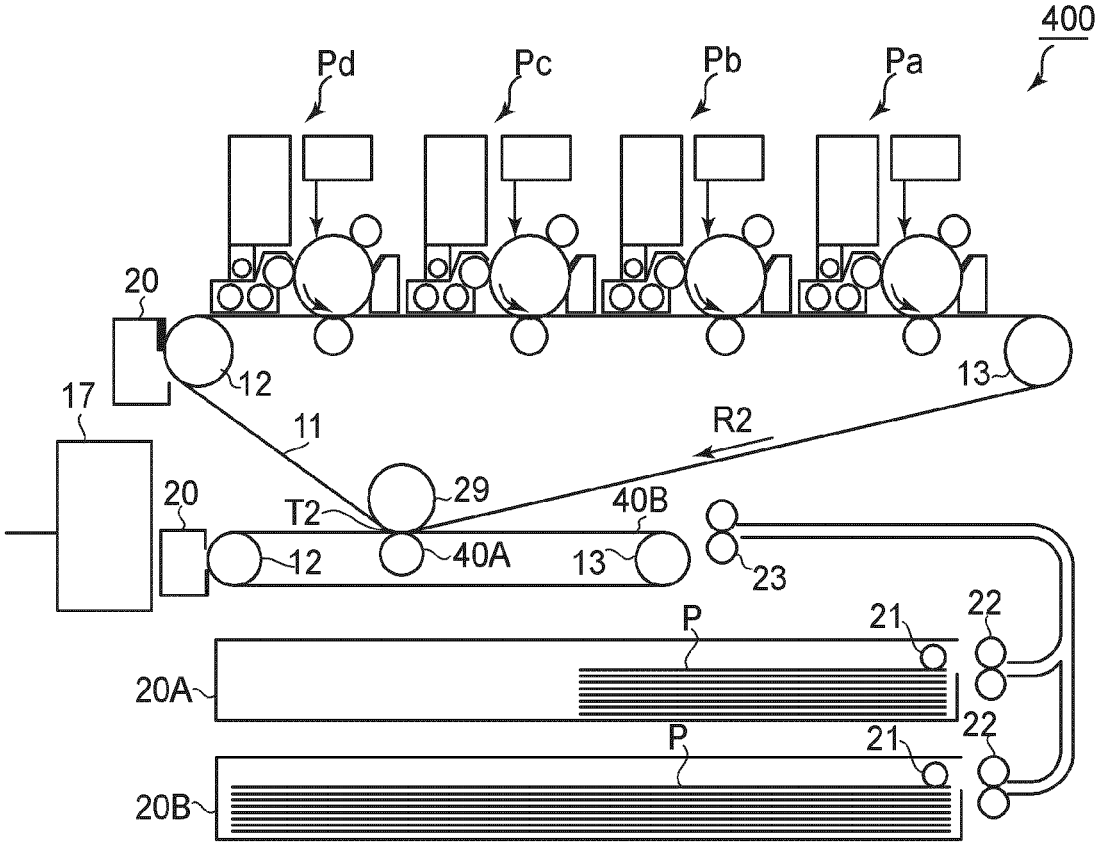
FIG. 17 is a schematic drawing of the image forming apparatus in the fourth preferred embodiment of the present invention, showing the structure of the apparatus.

FIG. 17 is a schematic drawing of the image forming apparatus in the fourth preferred embodiment of the present invention, and shows the structure of the apparatus.

The image forming apparatus 400 in the fourth preferred embodiment of the present invention is the same in structure as the image forming apparatus 100 in the first embodiment, except that its secondary transfer portion T2 is the same as the transfer portion T in the third embodiment. Therefore, the structural features of the image forming apparatus 400, which are the same as the counterparts of the image forming apparatus 100, which are shown in FIGS. 1 and 2, are given the same referential codes as those given to the counterparts of the image forming apparatus 100, and will not be described to avoid repeating the same descriptions. Further, the structural features of the image forming apparatus 400, which are the same as the counterparts of the image forming apparatus 300 in the third embodiment, are given the same referential codes as those given to the counterparts of the image forming apparatus 300, and will not be described to avoid repeating the same descriptions.

Referring to FIG. 17, the transfer roller 40A has an elastic layer formed of a foamable synthetic rubber, and an ion conductivity resistance adjustment agent dispersed in the rubber to adjust the elastic layer in resistance. Therefore, outputting a substantial number of prints which are the same in recording medium size makes the portions A of the transfer roller 40 and the portion B of the transfer roller 40 different in resistance by an extent which the ATVC sequence which is carried out once per job cannot satisfactorily overcome.

Thus, in a case where no less than 100 prints which are identical in recording medium size, are consecutively outputted in succession, and then, another image is formed on a recording medium, which is greater (wider) than the recording mediums which have been used in the preceding continuous image forming operation, the resistance difference reduction control sequence (S17-S20 in FIG. 5) is carried out before the operation for forming an image on the wider recording medium is started.

In the resistance difference reduction control sequence, the recording medium interval is increased, and transfer roller 40A is idled while a voltage, which is maximum in value and is the same in polarity as the voltage applied to the transfer roller 40A during normal transfer is applied. Thus, the portion B, which is lower in resistance than the portion A, becomes significantly greater in the amount of current than the portion A. Thus, the portion B becomes closer in the cumulative amount of current per unit area to the portion A, reducing thereby the difference in the amount of resistance between the two portions.

Embodiment 5

Figure 18:
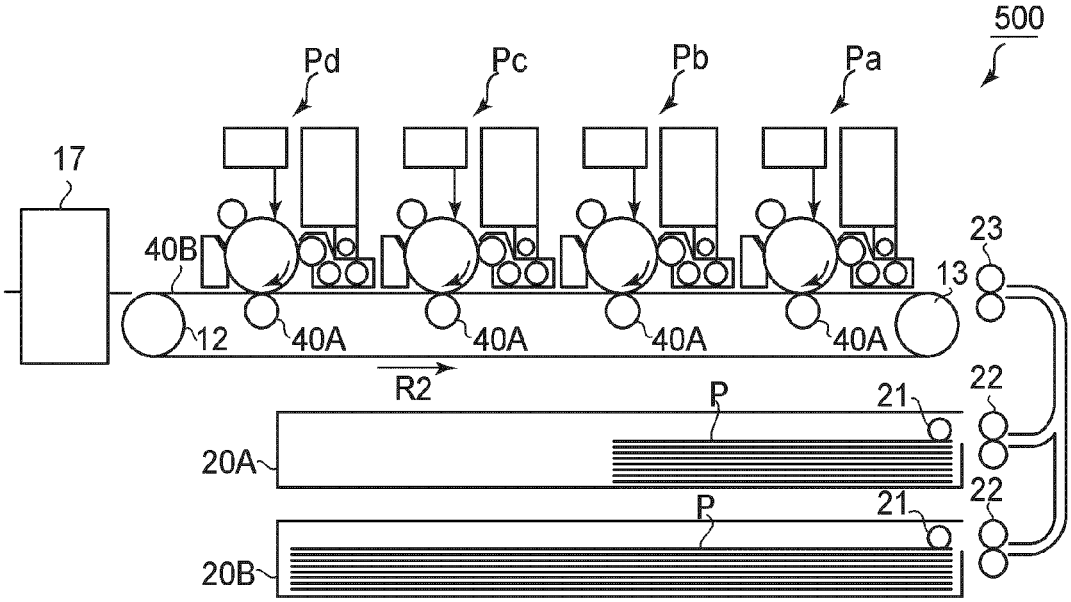
FIG. 18 is a schematic drawing of the image forming apparatus in the fifth preferred embodiment of the present invention, showing the structure of the apparatus.

FIG. 18 is a schematic drawing of the image forming apparatus in the fifth preferred embodiment of the present invention, and shows the structure of the apparatus.

The image forming apparatus 500 in the fifth embodiment is the same in structure as the image forming apparatus 100 in the first embodiment, except that the order in which the image forming portions Pa, Pb, Pc, and Pd of the image forming apparatus 500 are arranged is opposite to that in which the image forming portions Pa, Pb, Pc, and Pd of the image forming apparatus 100 are arranged. Thus, the Pa, Pb, Pc, and Pd of the image forming apparatus 500 will not be described to avoid the repetition of the same descriptions.

Referring to FIG. 18, the recording medium P is delivered to the recording medium conveyance belt 40B by the pair of registration rollers 23, and is electrostatically adhered to the recording medium conveyance belt 40B. Then, the recording medium P is conveyed sequentially through the image forming portions Pa, Pb, Pc, and Pd by the recording medium conveyance belt 40B while remaining adhered to the recording medium conveyance belt 40B. In the image forming portion Pa, a yellow toner image is formed and then, is transferred onto the recording medium P. In the image forming portion Pb, a magenta toner image is formed, and then, is transferred onto the recording medium P in alignment with the yellow toner image on the recording medium P. In the image forming portions Pc and Pd, a cyan toner image and a black toner image are formed, respectively, and then, are transferred in layers onto the recording medium P in a manner to be placed in layers on the yellow and magenta toner images on the recording medium P.

After the four toner images, different in color, are transferred onto the recording medium P, they are conveyed by the movement of the recording medium P to the fixing apparatus 17, in which the toner images are subjected to heat and pressure, being thereby fixed to the surface of the recording medium P. Thereafter, the recording medium P is discharged from the image forming apparatus 500.

The recording medium conveyance belt 40B is given a preset amount of tension by the tension roller 12, and is driven by the driver roller 13. The recording medium conveyance belt 40B is similarly structured to the recording medium conveyance belt 40B in the third embodiment, except for size. That is, it is formed of polyimide as base material, and an ion conductivity resistance adjustment agent dispersed in the polyimide to make the volume resistivity of the recording medium conveyance belt 40B fall within the range of $10^8$-$10^{12}$ Ω·cm.

The transfer roller 40A is similarly structured to the transfer roller 40A in the third embodiment. That is, it is made up of a core (axle) 40*a* formed of stainless steel, and an elastic layer 40*b* formed in a manner to cover virtually the entirety of the peripheral surface of the core 40*a*. The elastic layer 40*b* is made of a foamable synthetic rubber, and an ion conductivity resistance adjustment agent dispersed in the synthetic rubber to adjust the elastic layer in resistance.

Also in the case of the image forming apparatus 500, consecutively outputting in succession no less than 100 prints, which are the same in recording medium size, makes the portions A and B of the transfer roller 40A different in resistance by an amount which the ATVC sequence, which is carried out once per job, cannot sufficiently reduce.

Thus, in a case where no less than 100 prints which are identical in recording medium size, are consecutively outputted in succession, and then, another image is formed on a recording medium, which is greater (wider) than the recording mediums which have been used in the preceding continuous image forming operation, the resistance difference reduction control sequence (S17-S20 in FIG. 5) is carried out before the operation for forming an image on the wider recording medium is started.

In the resistance difference reduction control sequence, the recording medium interval is increased, and transfer roller 40A is idled while a voltage, which is maximum in value and is the same in polarity as the voltage applied to the transfer roller 40A during normal transfer is applied. Thus, the amount by which current flows through the portion B, which is lower in resistance than the portion A, is significantly greater than the amount by which current flows through the portion A. Thus, as the current flows through the transfer roller 40A, the portion B becomes closer in the cumulative amount of current per unit area to the portion A, reducing thereby the difference in the amount of resistance between the two portions.

As described above, an image forming apparatus in accordance with the present invention can reduce the amount of difference in resistance which occurs between a portion of the transferring member and another portion of the transferring member as a substantial number of prints which are the same in recording medium size are consecutively outputted in succession.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 244108/2007 filed Sep. 20, 2007 which is hereby incorporated by reference.

What is claimed is:

1. An image forming apparatus comprising:

an image bearing member configured to carry a toner image;

a rotatable transfer member constituting a transfer portion configured to transfer the toner image from said image bearing member onto a recording material;

a voltage source configured to apply a voltage of a predetermined polarity to said transfer member to transfer the toner image from said image bearing member onto the recording material;

an executing portion configured to execute an image forming mode for continuously forming images on a plurality of recording materials having different widths measured in a direction of a rotational axis of said transfer member;

an interval adjustment portion configured to adjust, when the images are formed continuously on the recording materials having a width smaller than a predetermined value during the execution of the image forming mode, an interval between adjacent recording materials to a first interval, and then to adjust the interval from the first interval to a second interval, wherein the second interval is larger than the first interval and is larger than an interval between adjacent recording materials during the execution of the operation in the image forming mode when the recording materials have a width larger than the predetermined value; and a voltage controller configured to control said voltage source to apply, during the second interval, a voltage of the predetermined polarity to said transfer member.

2. An apparatus according to claim 1, wherein said interval adjustment portion is capable of changing the second interval in accordance with a number of the recording materials having the same width continuously fed before the width of the recording material changes.

3. An apparatus according to claim 1, wherein the adjustment from the first interval to the second interval occurs when the number of image formations on the recording materials having the width smaller than the predetermined width reaches a predetermined number.

4. An apparatus according to claim 1, wherein said transfer member includes a roller, and the second interval is not less than a circumferential length of the roller.

5. An apparatus according to claim 1, wherein said voltage controller controls the voltage applied to the recording material such that the voltage applied to the transfer member at the second interval is higher than the voltage applied at the time of transferring the image onto the recording material.

6. An apparatus according to claim 1, wherein the interval between adjacent recording materials during the execution of the operation in the image forming mode when the recording materials have a width larger than the predetermined value is the same as the first interval.

* * * * *